US007579958B2

(12) United States Patent
Wallace

(10) Patent No.: US 7,579,958 B2
(45) Date of Patent: Aug. 25, 2009

(54) AUDIO POWER METER

(76) Inventor: Henry B. Wallace, 562 Oak Hill Rd., Fincastle, VA (US) 24090

( * ) Notice: Subject to any disclaimer, the term of this patent is extended or adjusted under 35 U.S.C. 154(b) by 1037 days.

(21) Appl. No.: 11/040,245

(22) Filed: Jan. 21, 2005

(65) Prior Publication Data

US 2005/0123144 A1 Jun. 9, 2005

Related U.S. Application Data

(63) Continuation-in-part of application No. 10/852,035, filed on May 24, 2004, now abandoned.

(60) Provisional application No. 60/475,575, filed on Jun. 3, 2003.

(51) Int. Cl.
*G09F 9/33* (2006.01)

(52) U.S. Cl. ..... 340/815.45; 381/56; 381/28; 84/454

(58) Field of Classification Search ..... 381/55, 381/56, 57, 58, 59, 28, 89, 120; 84/454, 84/616; 713/300, 340, 324; 700/94; 330/351, 330/354; 324/103; 340/662–664, 657, 660, 340/870.16, 540, 815.45, 815.4, 691.6
See application file for complete search history.

(56) References Cited

U.S. PATENT DOCUMENTS 3,959,735 A 5/1976 GrosJean
3,980,930 A 9/1976 Glogolja
3,991,370 A 11/1976 Pate
4,173,740 A 11/1979 Nagata et al.
4,199,758 A * 4/1980 Wilhelm et al. ..... 345/39
4,240,149 A 12/1980 Fletcher et al.
4,355,341 A 10/1982 Kaplan
4,398,061 A 8/1983 McMann, Jr.
4,405,831 A 9/1983 Michelson
4,527,156 A * 7/1985 Nawrocki et al. ..... 345/39
4,528,501 A * 7/1985 Dorrough et al. ..... 324/103 P
4,581,589 A 4/1986 Ikoma
4,887,298 A 12/1989 Haigler
5,128,566 A 7/1992 Killion et al.
5,255,324 A 10/1993 Brewer et al.
5,315,268 A 5/1994 Botti et al.
5,327,101 A 7/1994 Neely et al.
5,341,089 A 8/1994 Heep
5,365,201 A 11/1994 Shih et al.
5,528,695 A 6/1996 Klippel
5,532,649 A 7/1996 Sahyoun
5,633,940 A 5/1997 Wassink
5,719,526 A 2/1998 Fink
5,724,434 A 3/1998 Myers
5,734,725 A * 3/1998 Pritchard ..... 381/61
5,751,819 A * 5/1998 Dorrough ..... 381/56
6,201,680 B1 3/2001 Tokatian
7,113,603 B1 * 9/2006 Cahill ..... 381/55

* cited by examiner

*Primary Examiner*—Vivian Chin
*Assistant Examiner*—Lun-See Lao
(74) *Attorney, Agent, or Firm*—Gerald T. Bodner

(57) ABSTRACT

An audio power meter includes a circuit for measuring the power of an amplified audio signal outputted by an audio power amplifier to which the audio power meter is connected. The circuit generates an output signal indicative of the power of the amplified audio signal. A first bar display includes a plurality of separately illuminatable segments arranged linearly with respect to one another. Each segment of the plurality of separately illuminatable segments is responsive to the output signal of the circuit and is selectively illuminated in response thereto. When the measured power of the amplified audio signal exceeds a selected threshold power level, the amplified audio signal is attenuated.

6 Claims, 19 Drawing Sheets

AUDIO POWER METER

CROSS REFERENCE TO RELATED APPLICATION

This application is a continuation-in-part of U.S. application Ser. No. 10/852,035, filed on May 24, 2004 now abandoned, and entitled "True RMS Audio Power Meter", the disclosure of which is incorporated herein by reference, which prior application claims the benefit of U.S. provisional patent application Ser. No. 60/475,575, filed on Jun. 3, 2003, and entitled "True RMS Audio Power Meter", the disclosure of which is also incorporated herein by reference.

CROSS REFERENCE TO DOCUMENT DISCLOSURE

This application refers to, and incorporates, Document Disclosure No. 509276, filed with a Disclosure Document Deposit Request on Mar. 25, 2002 by the inventor herein, and entitled "PM-150 Audio Power Meter".

BACKGROUND OF THE INVENTION

1. Field of the Invention

The present invention relates to the measurement of power in a system consisting of audio power amplifier(s) (or simply, amplifier) and speaker(s), and a method of protecting the speaker(s) from power overload and damage, and possible consequential damage to the amplifier.

2. Description of the Prior Art

The present invention, an audio power meter (APM), is intended to measure and display the amount of power flowing from an audio amplifier to a speaker (or speakers in all that follows). The APM also acts to protect the speaker from overload and failure, and possible consequential damage to the amplifier when driving a failed speaker. There is a need for an inexpensive instrument that can be used by working musicians to gauge the amount of power they use in the practice of their art, and consequently the amount of sound they are producing. This is done in an effort to 1) provide consistent performances, and 2) protect the musician's equipment investment by preventing equipment damage. These goals are important when surveying the prior art.

As background, the user of the APM is typically a non-technical musician, unschooled in engineering. The user understands basically how to connect a speaker cabinet to an amplifier, but does not understand the concepts of voltage, current, or impedance. The user does understand the concept of power in the vague sense that more power equals louder sound, and that too much power damages speakers. The user is however acutely aware of the importance of equipment reliability, the tone the equipment lends to his unique artistic sound, the consistency of performance that his equipment enables, and the monetary and collector's value of his (perhaps antique) amplifiers and speakers. These factors also must be considered in the survey of the prior art.

Tokatian (U.S. Pat. No. 6,201,680, which issued on Mar. 13, 2001) teaches a speaker protection circuit which attaches to the signal path between the amplifier and speaker. The method promises fast transient response and rapid protection of the speaker. However, several disadvantages are apparent. The threshold of protection is a function of the impedance of the speaker, and if the user attaches a speaker of a different impedance (which is likely because musicians swap and trade equipment frequently), the protection may be compromised. The circuit judges a transient based on its voltage amplitude, which is of course load impedance dependent. This is a problem because certain voltage appearing across the terminals of an 8 ohm speaker represents a lower power than the same voltage appearing across the terminals of a 4 ohm speaker. Thus the protection of two speakers with identical power ratings is a function of the speaker impedance, which can be changed at any time by the user through replacement of the speaker. The relay contacts in the invention must potentially switch large voltages and currents in order to protect the speaker, requiring an expensive relay to avoid contact burn or sticking. The relay is the least reliable component in the taught invention, and should be avoided for maximum reliability. Additionally, for musical instrument application, the occurrence of fast transient signals is common, as produced by the musician, and a transient suppressor that operates as quickly as the invention's (65 nanoseconds) may cause audible and annoying side effects. Longer transients (6 milliseconds-14 milliseconds) that cause disconnection of the speaker by the invention are common in live musical performances.

GrosJean (U.S. Pat. No. 3,959,735, which issued on May 25, 1976) teaches a method whereby speaker overloads are prevented by disconnecting the power supply to the power amplifier in the case of overload. In the case of musical instrument amplifiers with which the APM is intended to be used, the power switching would have to be performed on the AC line input to the power amplifier in order to be generally applicable to many makes and models of amplifiers. This would require a significant power switching arrangement, either using large relays or power semiconductors. That in turn would require more stringent safety approvals and testing, and consequent increased cost. Additionally, restoring the audio power amplifier to working order after the overload has subsided may take several seconds due to delays in modern amplifier power supplies, or delays caused by warm-up in vacuum tube amplifiers. These delays are disruptive to musical performances.

Botti et al. (U.S. Pat. No. 5,315,268, which issued on May 24, 1994) teach a method of amplifier gain modification which causes a gain reduction in an upstream amplifier stage in the case that the output exceeds some preset reference level, this to avoid the engagement of thermal overload circuits in the amplifier which may cause distortion. While this method may ensure that the audio signal coming out of the amplifier is substantially distortion free at most temperatures (though at lower amplitudes), it does nothing to protect the speaker connected to the amplifier. Add to that the fact that many musicians actually seek to obtain distortion from their amplifiers, and the Botti et al. method is seen to be unusable in that application. Also, any amplifier or speaker protection mechanism that is temperature dependent is of less value because speaker protection must be performed at cold ambient temperatures as well as hot, as are found in outdoor performances. Further, the active electronic variable gain cell taught introduces noise into the signal path.

Ikoma (U.S. Pat. No. 4,581,589, which issued on Apr. 8, 1986) also teaches a clipping prevention technique that implements an upstream attenuation method. However, like the Botti et al. method, this invention seeks to prevent clipping and distortion. Once again many musicians actually seek to obtain distortion from their amplifiers, so the clipping criteria cannot be used to gauge amplifier performance or speaker protection. Protection of the amplifier or speaker must be judged using a more appropriate criteria, such as power moving to the load. Also, Ikoma teaches the use of a light dependent resistor in the attenuator stage. Such devices are highly nonlinear and introduce harmonic distortion of their own on the order of one to several percent when attenuating the audio signal, which is counterproductive to the application as intended. Such devices also consume significant power when used in battery operated equipment.

Fink (U.S. Pat. No. 5,719,526, which issued on Feb. 17, 1998) teaches a load monitoring method that computes power delivered to a load. This invention operates to monitor a load, but not to protect it. It also modifies the power amplifier transfer function internally (literally, "sends the control signals to the power amplifier") based on a calculation of the load impedance or power. The Fink patent specifies that the invention is to be applied "within" the amplifier chassis. Applying this technique to existing amplifiers would be impractical and would require internal modifications. For use with existing amplifiers, it would be better to retain such computed information within the power measurement device, and adjust the amplifier transfer function (specifically, gain) externally, negating the requirement to communicate with or modify the power amplifier at all. The advantage of the APM of the present invention over the Fink method is that no internal modifications are made to the amplifier. This is important when using the power meter and protection features with valuable antique amplifiers that would be reduced in value if modified in the least, even cosmetically.

Haigler (U.S. Pat. No. 4,887,298, which issued on Dec. 12, 1989) teaches a method of speaker protection that operates in more expensive installations (professional sound reinforcement systems) that include a speaker sense line. If the sense line fails (is disconnected for example), then the amplifier may overdrive the speaker. Haigler has invented a protection for a protective circuit, the protective circuit being the sense line. The APM of the present invention does not require or use a sense line, and is fully functional to protect a speaker without it. The Haigler invention waits a predetermined amount of time and re-enables full power to the load, and thus oscillates when the speaker sense line fails, causing an "aural indication that a failure on the sense line has been detected." This behavior is highly undesirable in musical performance settings. The APM of the present invention attenuates the audio until directed otherwise by the user, preventing distraction during a performance. This also prevents large signals from repetitively overdriving the loudspeaker.

Dorrough (U.S. Pat. No. 5,751,819, which issued on May 12, 1998) teaches a method of implementation of a level meter for display of digital audio streams. However, the invention uses average and peak voltage level measurements which are inferior to power measurements in the speaker protection application, since speakers are customarily rated not in peak or average voltage terms, but watts.

Neely et al. (U.S. Pat. No. 5,327,101, which issued on Jul. 5, 1994) teach a method of clipping reduction in an inverting operational amplifier. This method is inapplicable in external connection to existing audio power amplifiers and speakers such as used by musicians.

Klippel (U.S. Pat. No. 5,528,695, which issued on Jun. 18, 1996) teach a protection method for speakers which depends on the peak signal applied to the speaker. While this may provide some protection, it is impractical in application to existing musical instrument speakers because they are customarily not rated in terms of peak voltage, current, or power. The user has no idea of how to set the protection threshold using the Klippel invention. The APM of the present invention measures power and controls its audio attenuator using that result, and the user sets the protection threshold directly in terms of watts.

The above survey of prior art reveals many inventions that seek to protect amplifiers and speakers, but which are not suitable for use by the performing musician. The APM of the present invention is, however, designed exactly for that situation.

OBJECTS AND ADVANTAGES OF THE PRESENT INVENTION

Several objects and advantages of the audio power meter (APM) of the present invention are:

1. The APM is optimized to the musical instrument amplifier application and provides exactly the features needed by a working musician, including speaker and consequent amplifier protection from power overloads.
2. The APM encourages consistent performances by giving the musician a calibrated visual indication of exactly how much power is being used in the performance.
3. Since musicians consider the amplifier and speaker part of their tone-producing toolset, they tend to push the limits of the equipment in order to accomplish better performances. The APM allows the musician to do this without fear of equipment damage.
4. Since musicians play in many venues with widely varying acoustics, a calibrated reference is needed to display exactly how much power is being used in the performance. The APM provides this.
5. The APM is easy to use and requires no education or computation (such as compensating for various speaker impedances).
6. The APM gives the user a visual and audible indication of speaker protection.
7. The APM measures power in three ranges, suitable for a wide range of musician applications, from small clubs to concert halls.
8. The APM measures power in terms of averaged instantaneous power, which is most directly related to the amount of work being performed by a speaker and amplifier.
9. The APM is insensitive to the type of speaker used, its impedance, and the amplifier characteristics, up to the designed-for power limit for a particular embodiment.
10. In normal operation, the APM does not change the tone or amplitude of the signals passing through it.
11. Use of the APM conveys all its benefits without the need for modification of vintage, antique, or otherwise valuable musical equipment.
12. The APM prevents damage to possible irreplaceable equipment.
13. The APM prevents embarrassing disruptions of performances due to equipment failure.
14. The APM can be operated from the AC (alternating current) power line or from batteries, depending on the application.
15. The design of the APM ensures proper input/output isolation for the protected amplifier and speaker, to prevent oscillation. The presented embodiments demonstrate exceptional isolation.
16. The APM gives the user a choice of slow or fast response time, which the user can select to tailor the APM's operation to his playing style.
17. The APM indicates to the user the current power threshold visually.
18. The APM computes the power using an efficient but accurate logarithm approximation software technique.
19. The APM does not switch, or disconnect even briefly, the speaker signal between the speaker and amplifier.

20. No connection to or control of the AC power input of the amplifier is required.
21. The APM uses a mechanical relay and passive resistors to implement an attenuator that introduce practically zero noise into the signal path.

SUMMARY OF THE INVENTION

The typical arrangement used by musicians is shown in FIG. 1. A musical instrument 10 (electric guitar, electric bass, electric keyboard, voice, recording, or other such source of program material), with optional sound effects processing (not shown), is connected through a shielded signal cable 11 to an audio power amplifier 12. The signal level in the shielded signal cable 11 is approximately 0.5V (volts) RMS (root mean square) to 2V RMS. The audio power amplifier 12 typically has a voltage gain of 30 dB (decibel) to 40 dB, and also has a low output impedance to deliver power to a low impedance speaker 14 (typically 2 ohms to 16 ohms), through a heavy gauge speaker cable 13.

In audiophile music systems, the amplifier and speaker(s) are intended to pass the program signal without any coloration or distortion. However, musicians typically rely on the amplifier and speaker to contribute unique tone, coloration, and distortion effects to their performances. It is common for musicians to run their amplifiers in or near the clipping region to attain a richer sound than could be had from a low distortion stereophonic type of amplifier and speaker system. Additionally, musical instrument speakers color the sound in different amounts at different input power levels. The musician seeks these colorations and tones in an effort to attain his distinctive sound or reproduce the sound of famous musicians.

The musician tends to risk damage to the speaker by running it near the rated limit to get a subjectively good sound. If the speaker fails, then the amplifier can be damaged by high currents or voltages in the output stage(s). One would think that musicians would learn the limits of their equipment by experience. This is difficult though, because musicians play different venues sometimes every night of the week, and the varying acoustics of each hall or club makes estimation of loudness very subjective. What is needed is a way to prevent the speaker from being damaged by using an automatically protecting, calibrated power measurement device.

In FIG. 2, the APM of the present invention is shown connected to the typical musician's amplifier setup. A musical instrument 10 is connected through a shielded signal cable 11 to the APM 20. The audio signal passes through a variable attenuator in the APM and out to another shielded signal cable 21, to an audio power amplifier 12. The output of the amplifier 12 is routed back to the APM 20 through a heavy gauge speaker cable 22. The APM 20 measures the power flowing through it as the power passes through a heavy gauge speaker cable 13 to a speaker 14. If the APM 20 detects that the power has exceeded a user defined power threshold (with user selectable slow or fast response time), then the APM attenuates the audio signal passing into the amplifier through shielded signal cables 11 and 21.

This attenuation of the audio signal is accompanied by a characteristic blinking of the APM's LED (light emitting diode) bar graph display, or bar display. Thus, the user has a visual and audible indication of speaker protection. The user may activate a pushbutton on the APM to reset the attenuator to 0 dB, restoring the audio signal passing into the amplifier through shielded signal cables 11 and 21.

The APM presents the user with the option of slow or fast response time. The process of computing power from voltage and current necessarily includes the process of integration, which introduces a time delay in the measurement. This is unavoidable, but not detrimental because instantaneous power measurements are not warranted in this application. This is because the speaker cannot move a large distance instantly, being a spring-mass system which is also electrically inductive.

Unfortunately, musicians sometimes produce transients in their live performances. These transients are expected by the manufacturers of musical instrument amplifiers and speakers, and the equipment can handle some overload. It would be annoying for the APM to trip into a protective mode with every chord strummed strongly by a musician, but this could happen if the APM is too sensitive. Thus the user may select the APM's response time.

For a guitar player who uses little or no sound effects processing, the dynamic range can be great. The APM should be set for slow response time in this case, to prevent annoyance overload trips. However, the level of speaker protection is reduced. For musicians who use amplitude compression, or who play instruments such as electronic keyboards which have well behaved output amplitude characteristics, the response time of the APM can be faster, to catch the odd damaging transient that may occur, for example when an instrument is unplugged with the amplifier turned up. The user-selectable response time is described in detail in the discussion of APM software, below.

In case the user merely desires to measure the power moving from amplifier to speaker, the input circuit through cables 11 and 21 need not be connected to the APM 20, and the musical instrument 10 can be directly connected to the input of audio power amplifier 12, while retaining the routing of the amplifier output power signal through the APM 20 using heavy gauge speaker cables 13 and 22. It is also possible for the user to configure the APM 20 from its front panel to disable the power monitoring feature so the attenuator is never engaged.

The APM measures power in three ranges, suitable for a wide range of musician applications, from small clubs to concert halls.

DETAILED DESCRIPTION OF THE PREFERRED EMBODIMENTS

Figure 1:
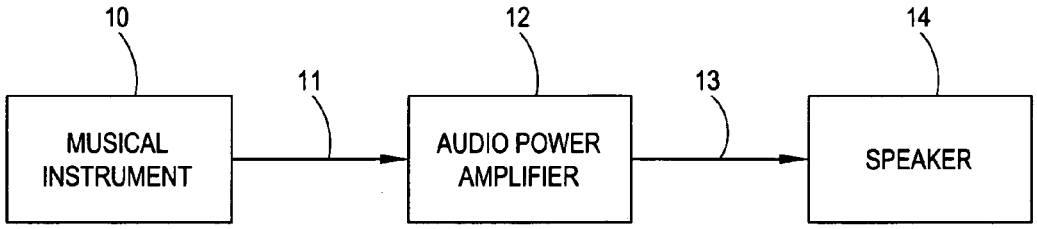
FIG 1. (PRIOR ART)
FIG. 1 is a block diagram of a typical amplifier/speaker arrangement used by musicians.

Amplifier manufacturers rate their products' output power in several different ways. Peak power, peak music power, program power, and RMS (root mean square) are all used. The generally accepted best technical measure of power is RMS. An RMS power rating discloses how much real (as opposed to reactive) power is being delivered to the speaker. Speakers are usually rated in RMS watts, so that is what should be measured to judge the power communicated between the amplifier and speaker and determine if the speaker rating is being exceeded.

It should be stated that there is technically no such thing as "RMS power." This is a marketing term that has crept into equipment specifications over the years. However, it has come to mean an expression of power that corresponds to the heat producing or dissipation equivalency of certain equipment. The actual measurement technique involves the averaging of numerous instantaneous power measurements and does not involve the normal root-mean-square process by which voltages or currents are measured. This time average of instantaneous power is customarily referred to as "RMS power," and that term is to be so understood herein.

The APM (audio power meter) of the present invention measures power by computing the true value from samples of the voltage and current in the speaker signal path. This method is insensitive to variations in the power factor of the load, as speakers are typically inductive, though resistive power dividers are sometimes used which yet change the phase angle of the load. The term "true RMS" is used as opposed to a calibrated RMS measurement technique that assumes some wave shape, such as a sinusoid. The sample-by-sample technique used in the present invention is insensitive to the shape of the waveform presented to the APM, within its measurement bandwidth.

The APM is not designed to prevent amplifier clipping. In fact, many musicians run their amplifiers in the clipping region to enhance musical sound effects and tone, so the power meter should not be sensitive to clipping, but accurately measure the power being delivered to the load, regardless of wave shape.

Special Characteristics of Musical Amplification Equipment

The APM measures power moving from amplifier to speaker. The APM is required to protect the speaker from an excess of power which can damage it permanently. There are several ways to do this, and many are taught in the prior art, most originating from the audiophile entertainment equipment field. However, musical instrument amplifiers and speakers are distinct in their properties from audiophile stereo and entertainment equipment in several respects.

The first special characteristic is tone. Musicians are extremely picky about the specific tone produced by the system combination of the instrument, amplifier, and speaker. The tone is also affected by the space in which the musician plays due to natural reverberation. The effect of acoustic coupling between the speaker and instrument is also important. Any change in one or more components or factors can render the system unusable or less than satisfying in the opinion of the musician. Damage, even minor, to any component is disastrous because the tone of the component will certainly change.

The second special characteristic is antique value. Many musicians prefer the tone of old amplifiers and speakers. Some of this equipment is 40 or 50 years old, and has considerable antique value in the market for vintage equipment. Damage to amplifier or speaker decreases the value of the equipment, sometimes drastically. Modification of an amplifier to incorporate any protection mechanism internally would reduce the value of the amplifier.

The third special characteristic is rarity. In many cases, antique amplifiers and speakers are irreplaceable if damaged, and cannot be repaired to restore them to their previous condition and sound because that condition was created in part by decades of aging of component parts. Even the most expensive stereo audiophile system components can be replaced off-the-shelf, or with equivalents if the original parts are obsolete, without a perceptible change in performance.

Protecting Musical Amplification Equipment from Damage

Given these special characteristics, it is imperative that a musician protect the amplifier and speaker from damage. Overload protection for speakers connected to vacuum tube amplifiers (which are popular with musicians) is especially important since a common failure mode for the speaker is an open voice coil, which leaves the amplifier driving an open circuit load, causing high voltage arcing within the output tube(s). To that end, the APM of the present invention uses a specific technique to lower the power delivered to the speaker when a user programmable power threshold is exceeded. There are several techniques that could be used to protect the speaker.

The first possible protection technique is to disconnect the speaker from the amplifier, as taught by Short (U.S. Pat. No. 4,538,296, which issued on Aug. 27, 1985) and Klauck (U.S. Pat. No. 4,034,268, which issued on Jul. 5, 1977). This technique would be disastrous for a vacuum tube amplifier, a type popular with musicians. The inductance in the amplifier's impedance matching output transformer would then store the energy from the output tube(s) and power supply and cause extremely high voltages to appear on the plate(s) of the output tube(s), causing arcing and destruction of the tube(s) and perhaps the power supply. In any case, a switching arrangement would have to be provided which could handle the full power of the amplifier under all normal circumstances, and that would be expensive. The additional resistance of the switching arrangement would also change the power transfer from the amplifier to the speaker, possibly upsetting fickle musicians.

The second possible protection technique is to switch the amplifier output to a dummy load. This technique would likewise leave the amplifier running with no load while the relay were switching to the dummy load, or would overload the amplifier briefly if a make-before-break switching arrangement were used. In any case, a switching arrangement would have to be provided which could handle the full power of the amplifier under all normal and abnormal circumstances, and that would be expensive. The additional resistance of the switching arrangement would also change the power transfer from the amplifier to the speaker, possibly upsetting fickle musicians. Considerable power must be dissipated by the dummy load while it is activated, and this is impractical from a size and cost perspective.

The third possible protection technique is to modify the gain of the amplifier internally to reduce the power level, such as the method of Nagata et al. (U.S. Pat. No. 4,173,740, which issued on Nov. 6, 1979), involving disconnection of the speaker and reduction in supply power to the amplifier. As stated previously, any modifications to vintage amplifiers can reduce the value of the equipment. Also, there are many makes and models of amplifier on the market, making generic modifications impractical or impossible.

The fourth possible protection technique is to decrease the input signal to the amplifier by some amount, or totally. This technique is simple and easy to implement, requires no modification to the amplifier, and results in no change in musical tone when the input signal is not being attenuated.

The fourth option is used by the APM of the present invention. The input signal is reduced by 20 dB when an overpower event occurs, and this reduction is maintained until the user deactivates it manually (as in the preferred embodiment), or until some predefined timeout elapses. This feature limits the power the musician can play into the speaker(s).

A visual signal is given when the APM is in this signal limiting mode in that the LED bar graph is logically divided into two halves which blink alternately at a rate of approximately 2 Hz (Hertz). Thus, the APM gives both a visual (blinking LED display) and audible (attenuated input signal) indication of active protection.

In the discussion of prior art, the automatic re-enabling of the amplifier/speaker system was stated to be detrimental to the equipment and possibly to the performance of the musician. While this is true, a longer predefined timeout for re-enabling of the amplifier/speaker system may be desirable because 1) the musician is controlling the signal source directly and manually and will necessarily stop playing when the APM indicates an overload, and 2) it may be convenient for the APM to automatically re-enable the amplifier/speaker system after a delay of one to two seconds, and after it senses that the offending signal has ceased, avoiding the need for the musician to manually reset the APM. This delayed re-enabling feature is not implemented in the present embodiments, but is a valuable feature.

The APM's signal attenuation section is configured to attenuate up to two input signals. That means that the user can monitor one output of a dual amplifier and automatically attenuate both inputs when needed. Since musicians often run dual musical amplifier setups with both channels operating at similar power levels, this is reasonable.

The Musician's Usual Operation of Amplification Equipment

Musicians are not generally educated in the engineering arts, and consequently are not as a whole aware that there may be a technical solution to the problem of speaker and amplifier damage as a result of misuse of such audio equipment. Since the sound the musician gets from his equipment is colored and affected by the amplifier and speaker operating near the non-linear limits of their capabilities, the musician is tempted to push the amplifier and speaker closer and closer to those limits in order to get a subjectively better sound. In the past, there has been no way for the musician to know how close the equipment is to the manufacturer's rating, resulting in unexpected and disappointing failure, which event can be economically disastrous if it happens during a live performance.

Live performances are governed by legal contracts which mandate a certain duration and schedule of performance. Disruptions to the schedule due to equipment failure are damaging to the reputation of the musician and may carry immediate financial and legal consequences.

Musicians have simply lived with this reality and risk since the invention of electronic amplification, mainly by comparing amplifier and speaker ratings. However, the nameplate rating of an amplifier may not correspond to its performance when driven into the clipping region, when it may produce much more than the rated output power. The APM of the present invention is an instrument that solves this problem, allowing the musician to get every last watt out of his equipment with no fear of damage.

Wide Equipment Compatibility

A power meter may assume the speaker has a certain impedance, 8 ohms for instance. However, speakers can vary widely from their nameplate impedance, depending on frequency. Add to that the complication that there is a real and imaginary component to the speaker's impedance, and less sophisticated power meters that measure only voltage or assume a certain load impedance are seen to be inadequate. It is not sufficient to measure the voltage across the speaker, because power is not proportional to voltage, but to voltage squared. It is also not sufficient to assume that the speaker is a pure resistive load, because it is not.

With the APM of the present invention, the musician can use whatever speaker is desired, and it intelligently computes the power coming from the amplifier, whether driving one speaker or more, or even a resistive power divider or dummy load (which musicians use to get the tone they want at reduced volume).

The APM is also insensitive to the type of amplifier being used, whether vacuum tube or transistorized, linear or one of the newer switching topologies.

No Loading of the Amplifier Output

A power meter could get its electric supply from the output of the amplifier by using diodes to rectify the audio signal and using this energy to power the instrument. This introduces distortion because the diodes are nonlinear and present a variable impedance to the amplifier over each cycle of the audio signal. The APM of the present invention is powered independently and so does not load the amplifier's output, and the musician hears exactly the same sound with or without it.

No Degradation of the Amplifier Input Signal

The input signal is connected straight through the APM of the present invention until an overload occurs, so there is no signal degradation at all. The APM uses a mechanical relay and passive resistor divider network that introduces for all practical purposes zero noise into the signal path when the device is not attenuating the signal. Since the low level signal in this path is very low power (typically a few volts RMS at an impedance level of a few thousand ohms), the relay contacts are not in danger of damage.

Consistency of Performance Enhanced

Musicians strive for consistent performances, and this is difficult on a personal level because even the emotional state of the musician can affect performance. The difficulty of the situation is compounded by the fact that musicians play in widely varying venues from night to night, where an amplifier/speaker combination may sound totally different, prompting the musician to increase volume levels to match the volume and tone had in another space, potentially damaging the equipment. Such adjustments are also a source of stress to the musician if the same sound cannot be achieved as was had in a different venue in a recent performance. Large volume changes from performance to performance annoy fellow musicians.

To address this consistency problem, the APM of the present invention provides a calibrated visual reference for the musician. Having a display of watts being delivered to the speaker allows each musician in a group to set levels similar to those used in practice sessions. The power is displayed on a large, bright LED bar graph. The bar graph is calibrated in watts, so the musician knows exactly how much real power the amplifier is producing. At a certain power level, the amplifier and speaker will sound the same from performance to performance because the level of distortion and coloring of the sound are a function of power.

Preferred Embodiment

The functions of the APM are presented in two embodiments, without prejudice against other embodiments carrying functions as claimed. The preferred embodiment (shown in FIG. 3A, front view, and FIG. 3B, rear view) is powered from the AC power mains using an inexpensive conventional wall transformer, and is preferred because musicians generally avoid the use of batteries due to the cost of frequent replacement and the probability of unexpected battery exhaustion. This embodiment can be rack mounted with an additional bracket (not shown), or set on an amplifier or speaker cabinet, or screwed to an equipment carrying case.

Figure 3A:
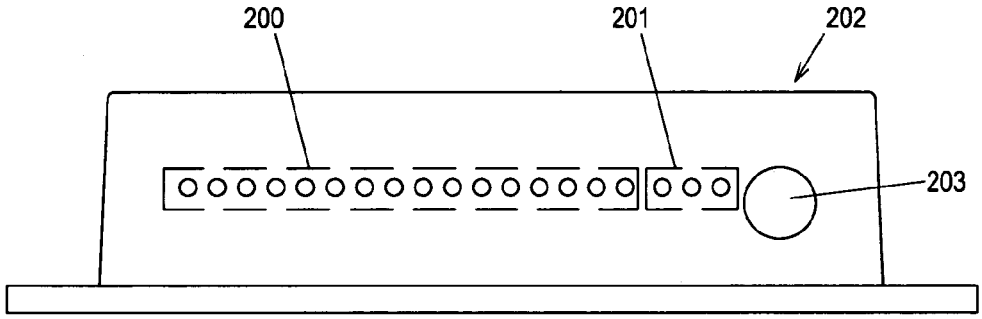
FIG. 3A is a front view of the preferred embodiment of the APM of the present invention.
Figure 3B:
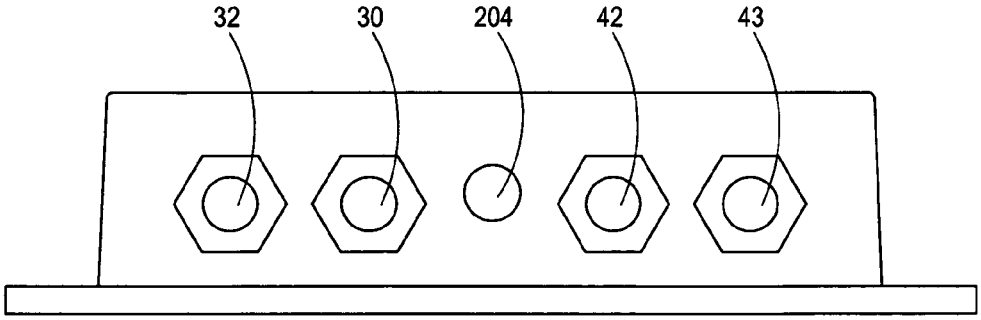
FIG. 3B is a rear view of the preferred embodiment of the APM of the present invention.

Referring to FIG. 3B, the APM is powered all the while the power cord is plugged in to the power jack 204. Power switching is typically provided by the musician as part of his equipment setup.

Connections to the APM are made through ¼ inch phone jacks, 30, 32, 42, and 43. The functions and connections of these jacks are described below.

Referring to FIG. 3A, front view, the APM has one-push-button operation with a momentary switch 203. This switch sets the power threshold, and resets the unit's attenuator to 0 dB attenuation after the power threshold has been crossed.

The display on the APM is a bar graph of bright LED's 200 that can be read at a distance. In many cases, a musician finds on stage that he cannot hear himself playing because of the sound produced by other musicians. A quick glance at the APM reassures the musician that his rig is working as it should, preventing him from turning up his volume and unbalancing the sound mix.

On the preferred embodiment, the display bar is a continuous bar graph of LED's whose illuminated length is proportional to the power measured. The bar's length increases from left to right in FIG. 3A as the measured power increases. The display bar is labeled on the front of the APM with numeric power values (not shown). The currently selected power range is shown on an LED power range display 201.

Alternatively, the power range display 201 may be eliminated and multicolor LEDs used in the power display bar graph 200. As an example of this display format, two-color LEDs would be used to indicate power in three power ranges. The low power range would be indicated preferably with a green LED color. The high power range would be indicated preferably with a red LED color. The medium power range would be indicated preferably with a yellow LED color, which is had by illuminating both the red and green LEDs simultaneously. More display colors could be used to indicate even more power ranges. In other respects, the power display bar graph 200 would operate as described herein.

The APM displays the current setpoint by blinking a particular LED in the power range display 201 at the user programmed power level. The flicker rate is approximately once per second, and gives the user an indication that the APM is active and that speaker protection is enabled.

Block Diagram of Preferred Embodiment

Figure 4:
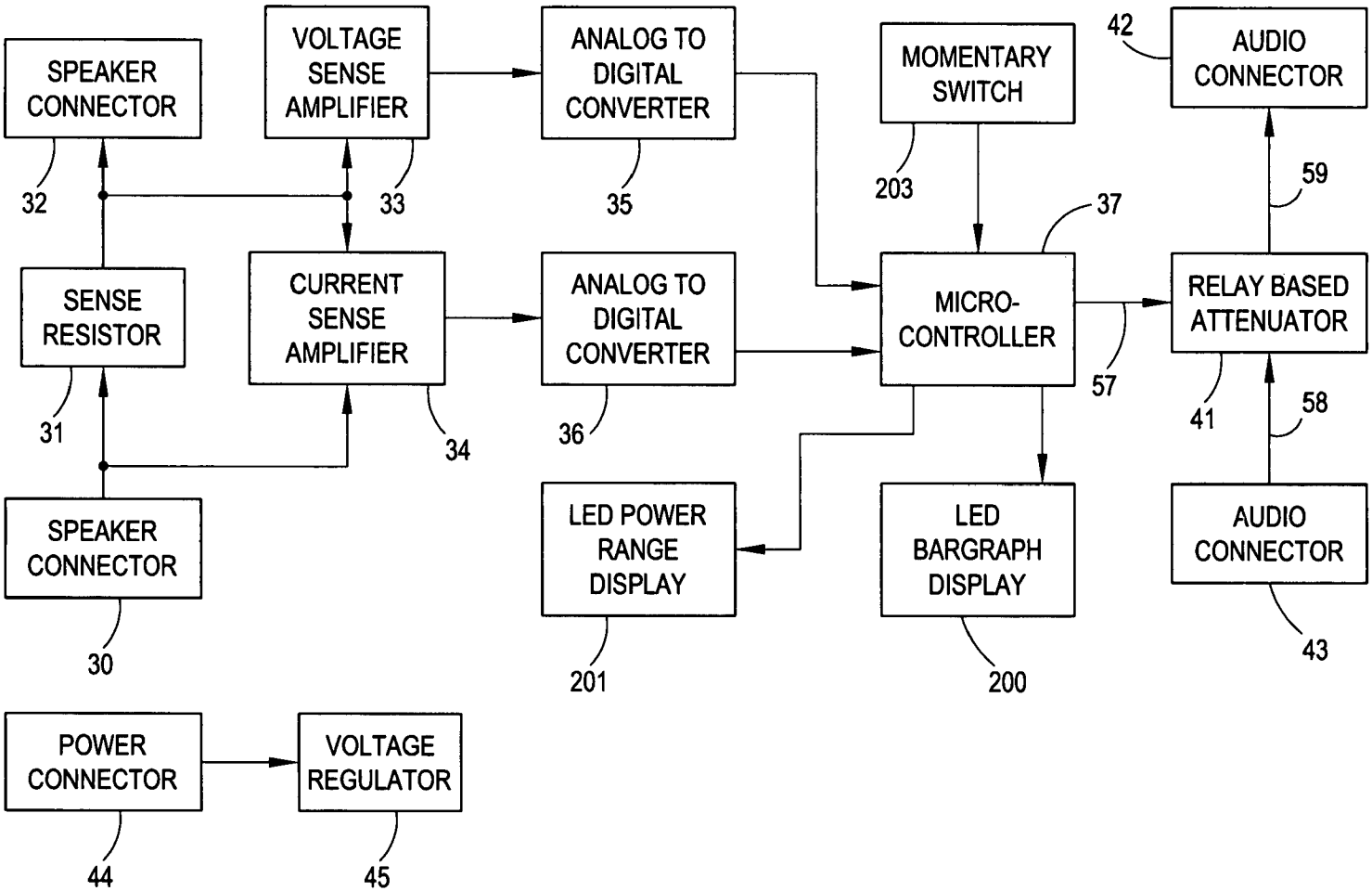
FIG. 4 is a block diagram of the internal circuit of the preferred embodiment of the APM of the present invention.

The block diagram of FIG. 4 shows the internal configuration of the preferred embodiment APM of the present invention. Assuming a system connection as in FIG. 2, the speaker signal comes into speaker connector 30 from the user's power amplifier, the connector being a ¼ inch phone jack or other connector suitable for the power level being measured. The signal passes through preferably a 5 milliohm sense resistor 31, which is a circuit board trace or discrete resistor, and this resistance develops a small voltage drop (or current sense signal, less than 50 millivolts) in the presence of the power flowing through it. The signal then proceeds to a speaker connector 32 where it resumes its journey to the speaker. The direction of the speaker signal through the APM is unimportant because the APM is simply measuring the voltage across the signal lines and current through them.

Voltage sense amplifier 33 scales the voltage on the speaker signal down to a usable value (the voltage sense signal), with a gain of about 0.012, since the analog to digital converter 35 has a full scale range of only 0V to 2.5V. The amplifier 33 drives an analog to digital converter 35. The amplifier 33 also sets the DC bias point to the midpoint of the analog to digital converter 35 measurement range, approximately 1.25V. This operational amplifier design is conventional and well known to persons practiced in the art.

Current sense amplifier 34 amplifies the voltage appearing across the sense resistor 31 by a factor of about 15. The amplifier 34 drives an analog to digital converter 36. It also sets the DC bias point to the midpoint of the analog to digital converter 36 measurement range, approximately 1.25V. This operational amplifier design is conventional and well known to persons practiced in the art.

Amplifiers 33 and 34 preferably also low pass filter the audio to prevent aliasing problems during sampling. The amplifiers present a high impedance of thousands of ohms to the speaker signal, not loading it, preventing distortion.

Analog to digital converters 35 and 36 are part of a microcontroller integrated circuit (IC) 37 used in the embodiments, but they could be separate devices as dictated by space or cost constraints. The microcontroller 37 contains its own RAM (random access memory) and reprogrammable program memory. The microcontroller 37 preferably reads the analog to digital converters 35 and 36 approximately 20,000 times per second, yielding a theoretical maximum usable signal frequency of 10 KHz (kilohertz). Amplifiers 33 and 34 are preferably designed to roll off high frequency signal content at a rate of about 12 dB/octave starting at about 8.8 KHz. Signal bandwidth is preferably limited to about 8.8 KHz, sufficient for musical instruments such as guitars, keyboards, and voices, but this is not a limitation of the general principles disclosed here.

Once the data from analog to digital converters 35 and 36 are read into the microcontroller 37, the software performs a power computation and drives the LED display bar graph 200.

The user controls the APM using a momentary pushbutton switch 203, accessible from the front panel. Part of this control is selection of the power range of the APM. The presented embodiments use full scale power ranges of 13W, 53W, and 150W, though other ranges could be used as needed. The currently selected power range is shown on the LED power range display 201.

Referring to FIG. 3A, front view of the APM 202, the power range LED's 201 are preferably green, whereas the bar graph 200 is composed preferably of red LEDs. The user pushbutton 203 is also shown. The power range LED's 201 are located to the right of the bar graph 200, at the high power end. The low power end of the bar graph 200 is on the left in the figure. This placement gives the user a visual indication of the physical extent of the display on a dark stage because the green power range LED's 201 define the position of the highest power display position on the bar graph 200, and any amplifier power greater than 0.5 watts lights the leftmost red LED(s). Playing in various venues where the stages are different sizes, this simple placement of the green power range LED's gives the musician an instantly familiar reference when looking at the APM, even in unfamiliar surroundings or in the dark.

Referring again to FIG. 4, when the APM is not detecting a power overload, it sets relay based attenuator 41 to pass the low level audio signal straight through from audio connector 43 to audio connector 42. This is a dual signal path, and the audio connectors 42 and 43 are TRS (tip-ring-sleeve, commonly known as stereo) ¼ inch phone jacks in the presented embodiments. The relay is preferably a double pole type that controls the attenuation in each path simultaneously while maintaining isolation between the two signals of the pair. When the APM detects a power overload (it is in the overload mode), it sets relay based attenuator 41 to attenuate the low level audio signal preferably 20 dB from audio connector 43 to audio connector 42 using a simple resistive voltage divider. The relay effects 20 dB attenuation in each path simultaneously.

Schematic of Preferred Embodiment

Figure 5A:
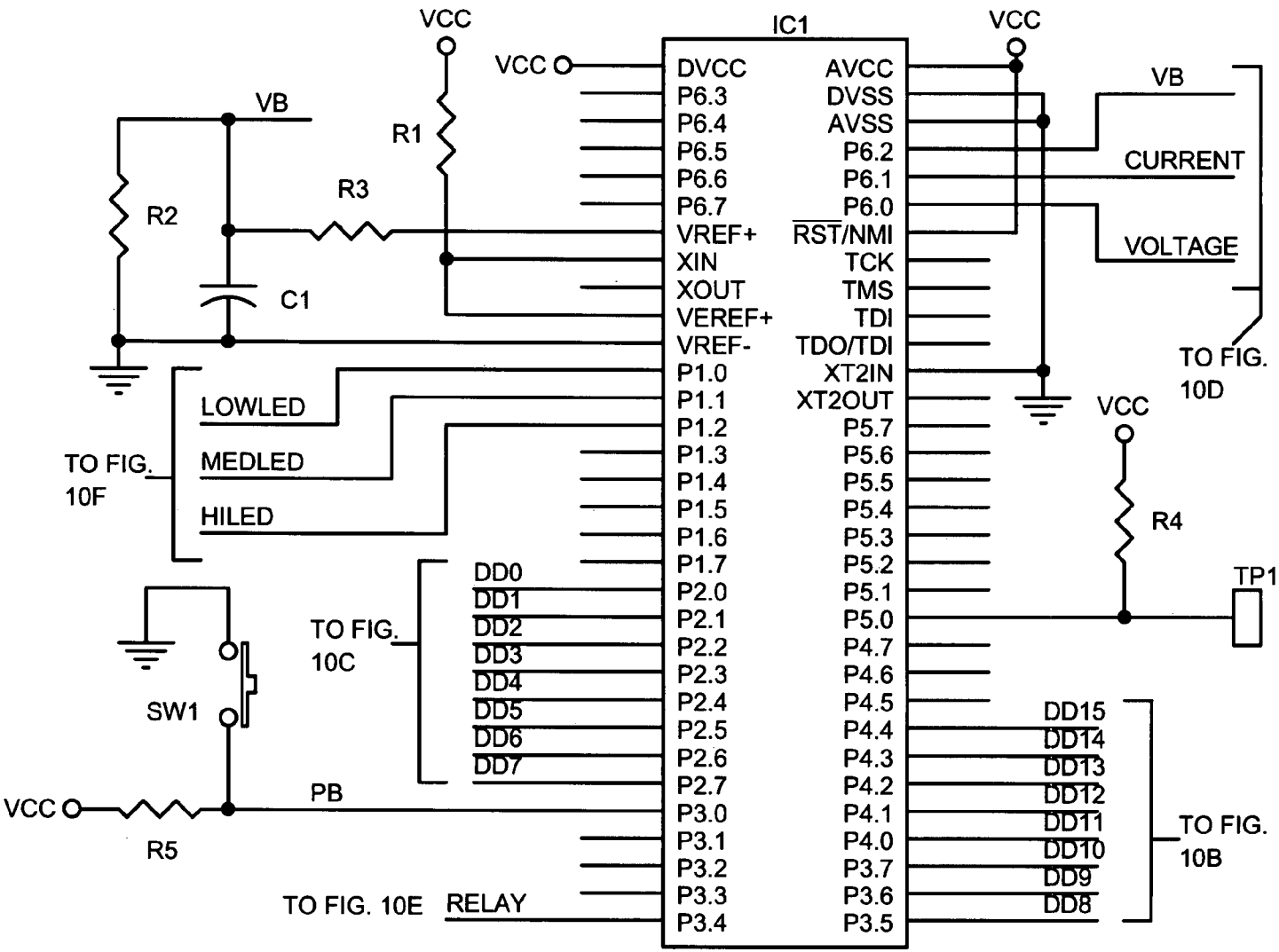
FIG. 5A through FIG. 5K are the schematics of the preferred and alternative embodiments.

The schematic of the preferred embodiment is shown in FIG. 5A through FIG. 5G. Referring to FIG. 5A, a microcontroller IC1 controls all functions of the APM. This device is typically a Texas Instruments MSP430F147 type or equivalent. Pin names and functions are assumed to be for the MSP430F147 type, but other microcontrollers may be used without loss of generality. Pins not shown connected on the schematic are configured as low impedance outputs or may be safely left not connected according to the manufacturer's specifications. Other functions such as programming the microcontroller with the software program, power supply bypassing, and physical mounting are not covered here because they are documented fully by the manufacturer, are well known, and do not pertain to the specific operation of the APM.

Across all schematic subsections, the symbol VCC represents a voltage of 3.3 volts DC, and the symbol VS represents the voltage of approximately 6 volts DC. The signal ground symbol indicates that all wires with such a symbol are connected together within the embodiment. The term LOW is defined as logic zero, typically a voltage less than 20% of VCC. The term HIGH is defined as logic one for 3.3V logic, typically a voltage greater than 80% of VCC. These ratios are true for all valid VCC values as specified by the manufacturer(s) of the integrated circuits.

Referring to FIG. 5A, a resistor R1 (typically 10K ohms) is used to pull the voltage at pins XIN and VEREF+ to a known, stable level (HIGH).

A switch SW1 is the user pushbutton, and it is connected in a normally open, active LOW configuration, with a resistor R5 (typically 10K ohms) pulling the switch signal HIGH when the switch is open. Depression of the switch causes input P3.0 on microcontroller IC1 to go LOW.

A test point TP1 is pulled HIGH by a pull up resistor R4 (typically 10K ohms). This test point may be shorted to ground (logic LOW) in order to initiate the calibration function of the APM, described in detail below.

Microcontroller IC1 contains an internal multi-channel analog to digital converter and voltage reference generator. This reference voltage (2.50V DC) is available on pin VREF+ and is used by the APM to bias the measurement amplifiers, described below. A suitable bias voltage VB (approximately 1.25V DC) is had by dividing the voltage at VREF+ by two, and this is done by resistors R2 and R3 (typically 10K ohms each). This bias voltage VB is filtered by a capacitor C1 to remove any high frequency noise.

Figure 5B:
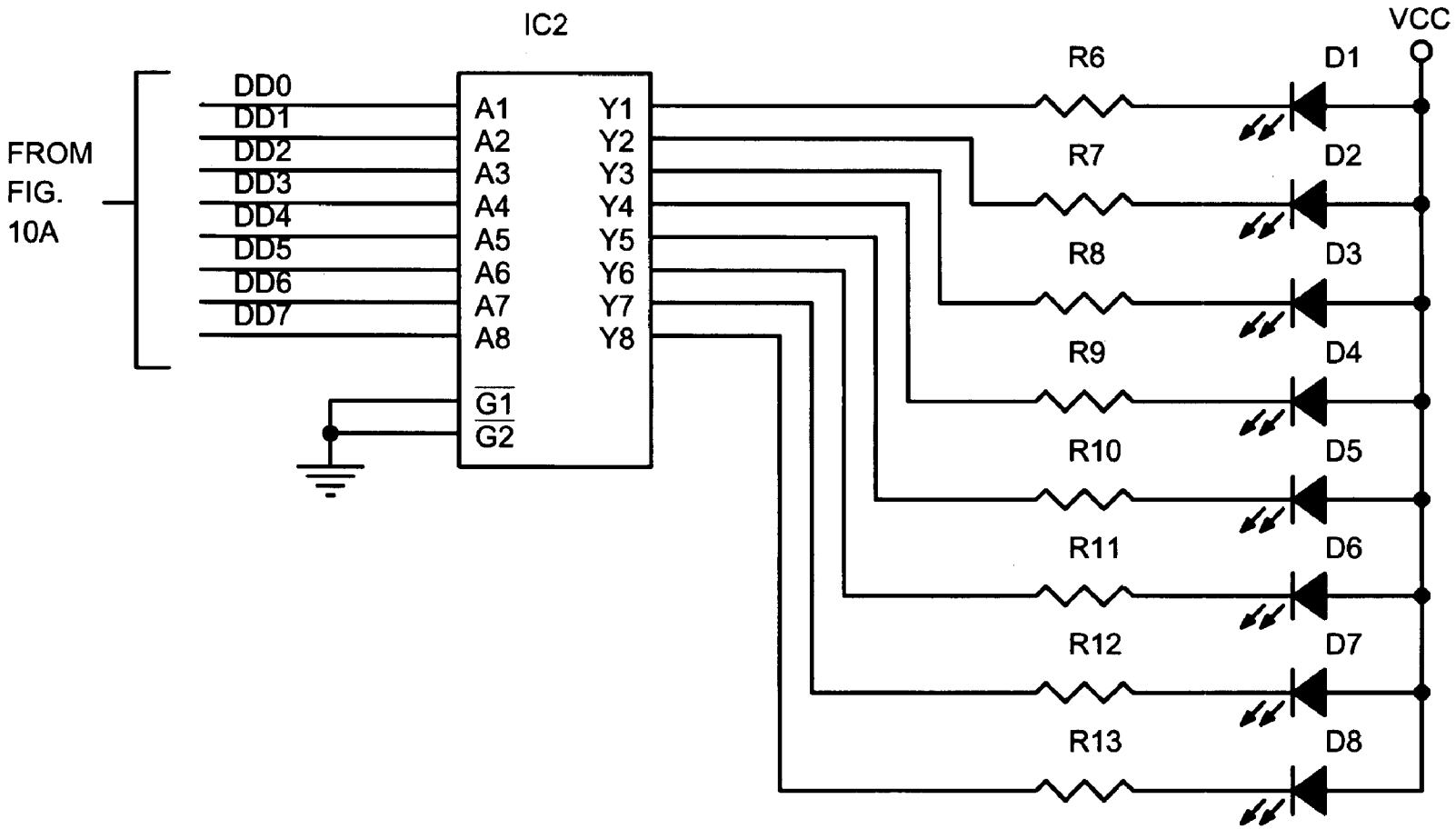
Figure 5C:
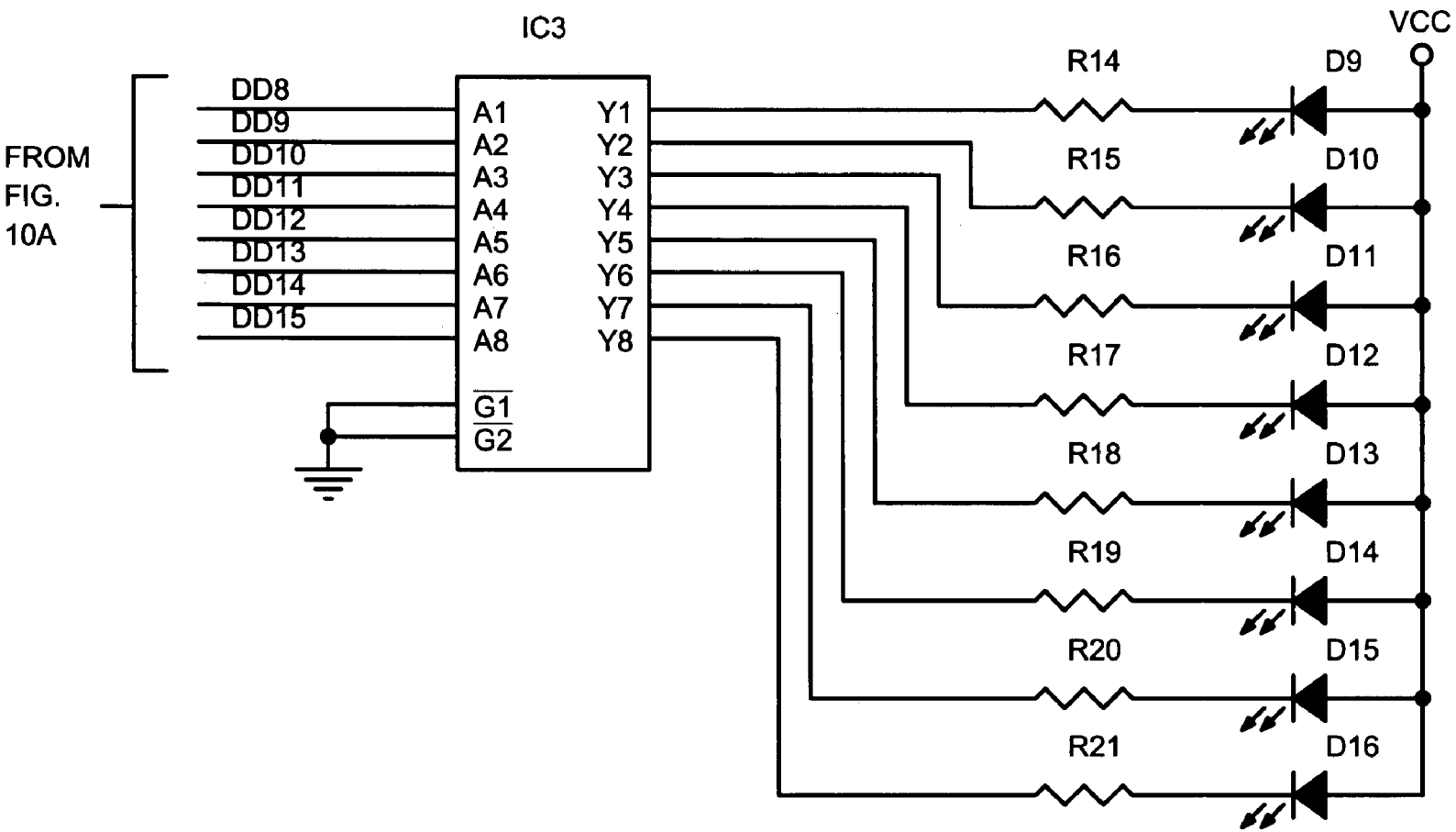
Figure 5D:
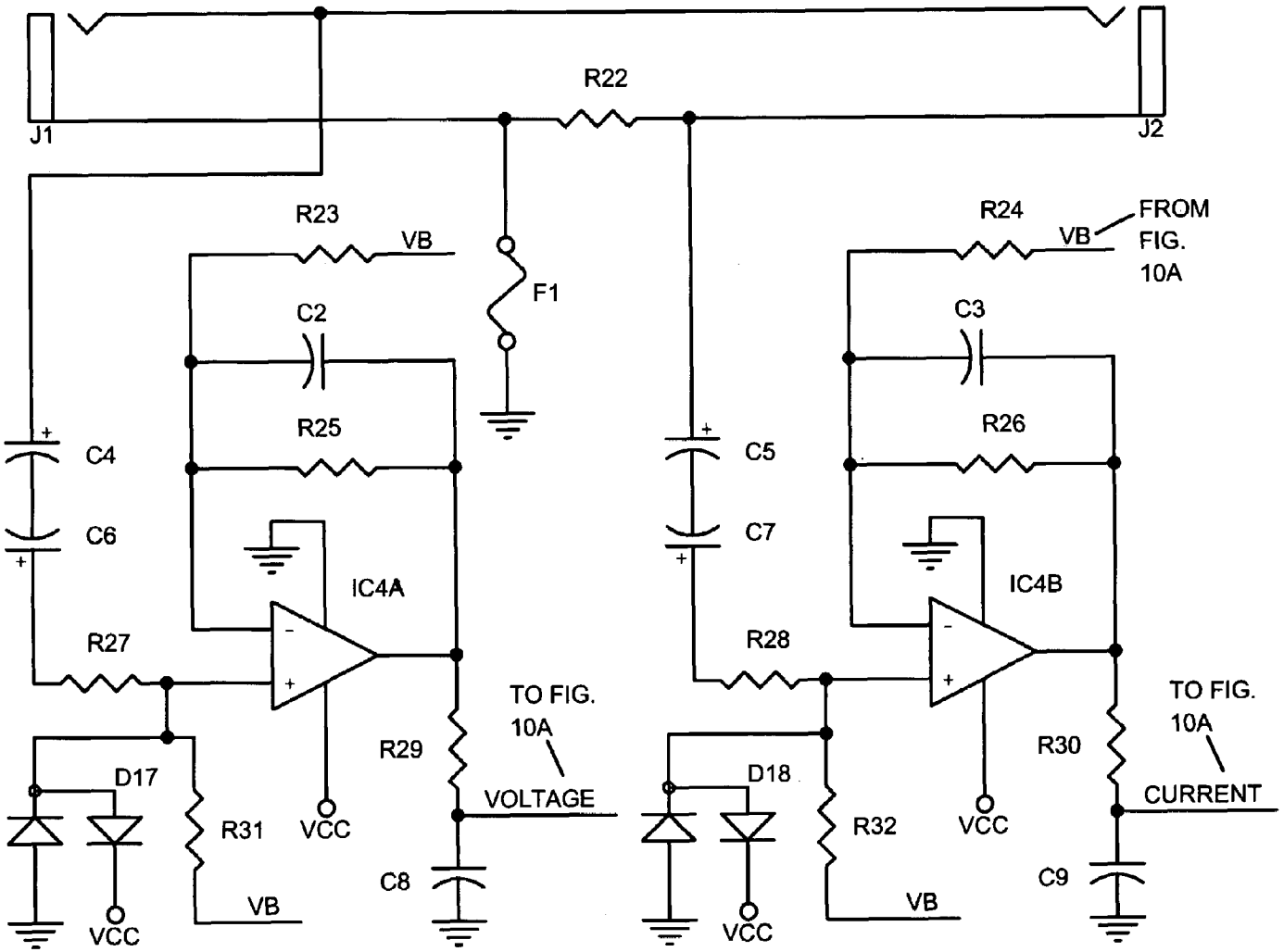

Signal VB is used by the current and voltage amplifiers in FIG. 5D to bias them near mid-supply, so that they may operate in their linear regions. Signals CURRENT and VOLTAGE from FIG. 5D arrive at the microcontroller IC1 at pins P6.1 and P6.0, respectively. These signals carry the voltage and current information that the software uses to compute the power flowing to the speaker. Signal VB is also measured by the microcontroller IC1 at pin P6.2 so that the DC offset of the signals CURRENT and VOLTAGE may be eliminated from the computations.

Figure 5E:
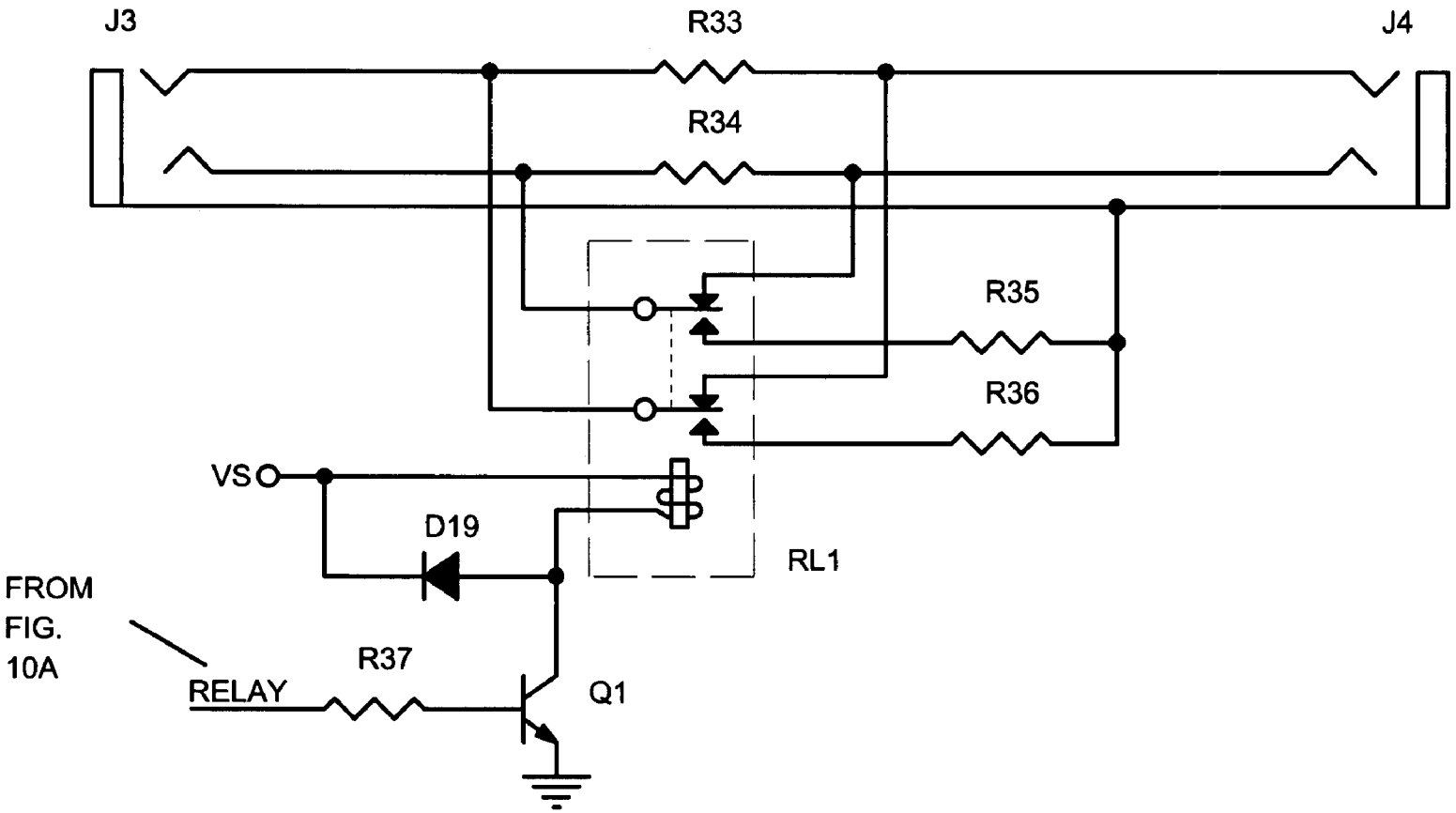

The microcontroller IC1 controls the relay based attenuator using signal RELAY, and the attenuator is shown fully in FIG. 5E.

The microcontroller IC1 drives the displays of the APM through signals labeled DD0-DD15, LOWLED, MEDLED, and HILED. Signals DD0-DD7 control the least significant LEDs in the bar graph, DD0 corresponding to the lowest power LED. Signals DD8-DD15 control the most significant LEDs in the bar graph, DD15 corresponding to the highest power LED. Signals LOWLED, MEDLED, and HILED control the low, medium, and high power range LEDs, respectively. These signals are shown schematically connecting to devices in other figures, described presently.

Referring to FIG. 5B, an octal bus driver device IC2, typically a 74HC541 or equivalent, receives signals DD0-DD7 from microcontroller IC1 in FIG. 5A. The bus driver is used to drive the LEDs because the microcontroller does not have enough current drive to do the job alone. Resistors R6-R13 (typically 120 ohms each) are used, one each, to limit the current through LEDs D1-D8. When a signal DD0-DD7 goes LOW, the corresponding LED D1-D8 lights. Any combination of zero or more LEDs may be lit by the software program through microcontroller IC1.

Referring to FIG. 5C, an octal bus driver device IC3, typically a 74HC541 or equivalent, receives signals DD8-DD15 from microcontroller IC1 in FIG. 5A. The bus driver is used to drive the LEDs because the microcontroller does not have enough current drive to do the job alone. Resistors R14-R21 (typically 120 ohms each) are used, one each, to limit the current through LEDs D9-D16. When a signal DD8-DD15 goes LOW, the corresponding LED D9-D16 lights. Any combination of zero or more LEDs may be lit by the software program through microcontroller IC1.

Referring to FIG. 5D, the voltage and current values are conditioned by amplifiers IC4A (voltage), and IC4B (current). Bias for both amplifiers is provided by signal VB from FIG. 5A. The signal ground reference for both amplifiers is the sleeve contact on audio jack J1, taken through a polymer fuse F1, which normally has a very low resistance (less than 10 ohms).

The voltage across the speaker signal line is sampled by capacitors C4 and C6 (typically 2.2 microfarads each), connected in a nonpolar configuration. A noninverting operational amplifier circuit IC4A is used to condition the voltage signal, in conjunction with resistors R27 and R23 (both 1 megohms), and R25 and R31 (both 12K ohms). The DC gain of the amplifier is approximately 0.012, which is 12K ohms divided by 1 megohm. The high frequency gain of the amplifier is reduced by capacitor C2 (one nanofarad). The high frequency gain is further reduced by resistor R29 (820 ohms) and capacitor C8 (10 nanofarads), resulting in an overall two pole lowpass filter with an approximate cutoff frequency of 8.8 KHz. The filter response is not critical as it is only used for anti-aliasing before the analog to digital conversion. The resulting signal, VOLTAGE, passes back to microcontroller IC1 in FIG. 5A.

The current in the speaker signal line is sampled by a resistor R22, either a discrete resistor or a circuit board trace. The resistor R22 converts the speaker current to a small voltage, and this voltage is coupled through capacitors C5 and C7 (typically 2.2 microfarads each), connected in a nonpolar configuration. A noninverting operational amplifier circuit IC4B is used to condition the current signal, in conjunction with resistors R24 and R28 (both 10K ohms), and R26 and R32 (both 150K ohms). The DC gain of the amplifier is approximately 15.0, which is 150K ohms divided by 10K ohms. The high frequency gain of the amplifier is reduced by capacitor C3 (68 picofarads). The high frequency gain is further reduced by resistor R30 (820 ohms) and capacitor C9 (10 nanofarads), resulting in an overall two pole lowpass filter with an approximate cutoff frequency of 8.8 KHz. The filter response is not critical as it is only used for anti-aliasing before the analog to digital conversion. The resulting signal, CURRENT, passes back to microcontroller IC1 in FIG. 5A.

The amplifiers IC4A and IC4B, as configured, present a high impedance to the speaker signals, not loading them, thus preventing distortion of the audio signal.

Dual clamp diodes D17 and D18 prevent damage to the amplifiers IC4A and IC4B in case of high current or voltage spikes, or static electric discharge.

Fuse F1 is the sole low impedance connection between the signal ground of the APM and the speaker. This fuse is present just in case of a failure in the power supply or other component of the APM, to prevent high currents from flowing to the externally connected amplifier or speaker.

The relay based attenuator is shown schematically in FIG. 5E. Audio jacks J3 and J4 provide connections for the low level signal as previously described. Two pairs of resistors form "L-pads", a conventional form of audio attenuator. A resistor R33 (10K ohms typical) and a resistor R36 (1K ohms typical) form one attenuator, and a resistor R34 (10K ohms typical) and a resistor R35 (1K ohms typical) form the other. These attenuators provide approximately 20.8 dB attenuation. A relay RL1 controls the attenuation level. The relay coil is controlled by the microcontroller IC1 through a driver transistor Q1 and energized by signal RELAY going HIGH (from FIG. 5A) when a power overload is detected. In the position shown, relay contacts short resistors R33 and R34, leaving resistors R35 and R36 open circuit, providing no attenuation. In the other position of the contacts, the attenuator functions as an "L-pad" as described. This is a very low noise, high isolation attenuator, isolation being measured between the signals being attenuated and the relay coil, which is indirectly connected to the amplifier's speaker circuit through the ground signal at the emitter of driver transistor, Q1. Diode D19 clamps the inductive spike when relay RL1 is de-energized (when Q1 is turned off by signal RELAY going LOW).

Figure 5F:
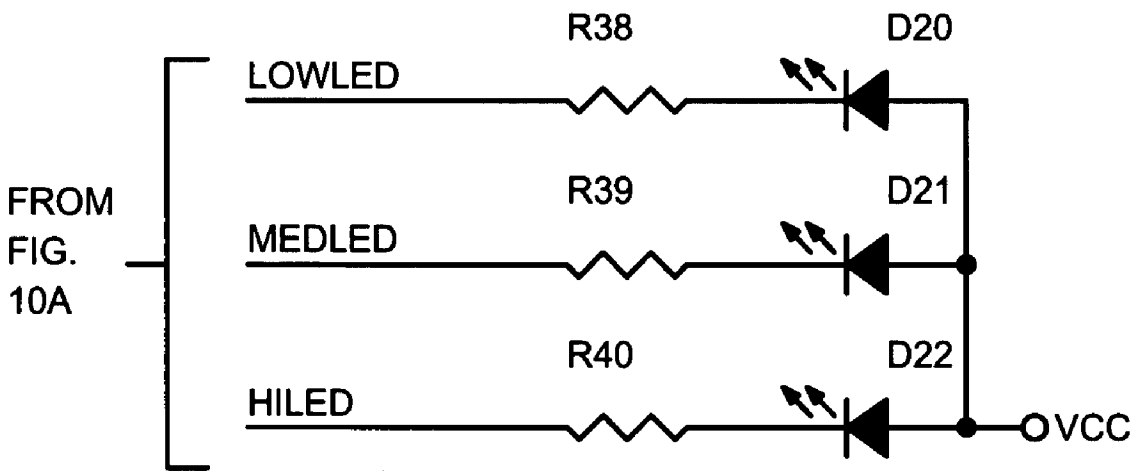

Referring to FIG. 5F, green LED's D20-D22 indicate the power range being used, and also give the user a visual indication of the physical extent of the display on a dark stage. This is because the green LEDs are located at the high power end of the bar display. Signals LOWLED, MEDLED, and HILED control the low, medium, and high power range LEDs, respectively, and come from microcontroller IC1 in FIG. 5A. An LED is lit when its respective signal is LOW. Resistors R38-R40 limit the LED current.

Figure 5G:
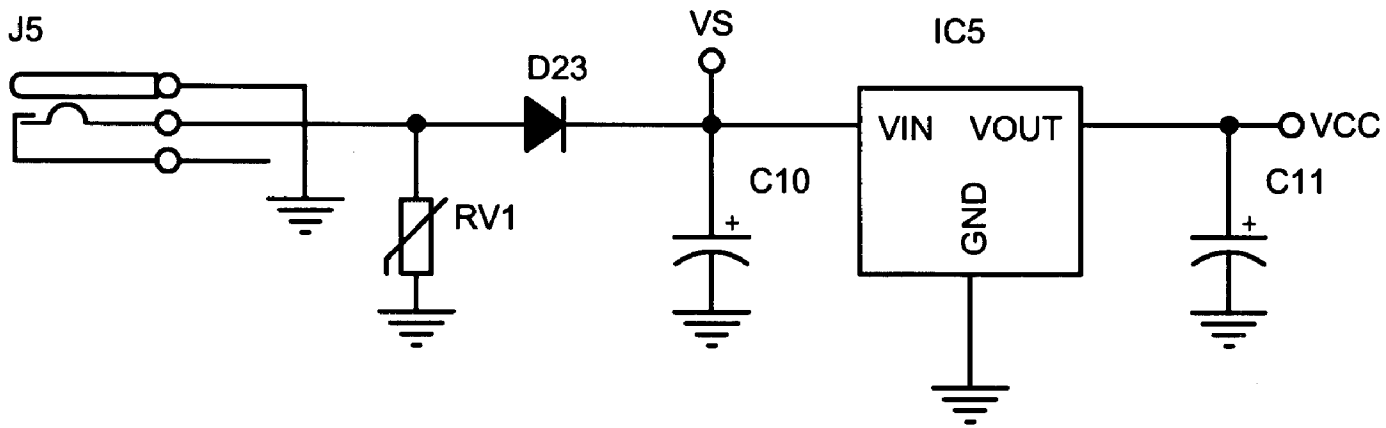

Referring to FIG. 5G, the APM is powered all the while the wall transformer is plugged into a coaxial power jack J5. A diode D23 is used to protect against reversal of polarity, possible if the user connects the wrong wall transformer. A 15 volt varistor RV1 suppresses voltage transients coming off the AC power mains, preventing damage to the APM. A 3.3V DC voltage regulator IC5 regulates the approximately 6V DC signal at its input down to 3.3V DC. Filter capacitors C10 and C11 are used to suppress noise on the power supply signals. Signal VS is used to power the relay coil driver shown in FIG. 5E.

The negative lead of the DC power input is the reference for the measurement circuit and is connected to one side of the speaker signal being sensed. This is not a problem because the wall transformer presents a very high common mode impedance to the power line, preventing any noise or harmful voltages from coupling into the speaker circuit. Just in case there is a failure in the Underwriter's Laboratories listed wall transformer, a self resetting low current rating polymer fuse is used to connect the speaker to the measurement circuit for protection.

Returning again to FIG. 4, while the APM is in overload mode, attenuating the signal from audio connector 43 to audio connector 42, the microcontroller 37 blinks alternately each logical half of the LED bar graph display 200 at a rate of approximately 2 Hz. This informs the musician that the power threshold has been crossed.

Signal paths 59 and 58, and the relay coil drive signal 57 are isolated on the circuit board of the APM using the external power amplifier's ground from connectors 43 and 42. This is important because the reference of the speaker signal may not be chassis ground of the amplifier, in the case of some output driver circuits or a bridge tied speaker load. Thus, the signals on connectors 30 and 32 may be nonzero when measured with respect to the chassis ground of the amplifier. To prevent coupling of the input and output signals of the amplifier and potential oscillations, the input circuit of the APM is shielded using conventional techniques. The signal 57 that activates the relay is a potential source of detrimental signal coupling, since the microcontroller 37 ground reference is actually one of the speaker signal conductors (the sleeve conductor on the ¼ inch phone jacks 30 and 32), but the relay has so little capacitive coupling, about 0.5 picofarads from coil to contacts, that the isolation is sufficient. Thus, the relay is the focus of input/output isolation in this embodiment.

A power connector 44 receives a DC (direct current) power signal from an inexpensive wall transformer, which is regulated to a voltage suitable for the circuitry (typically 3.3VDC) by a voltage regulator 45. One conductor of the power supply connector 44 is connected to the speaker connectors 30 and 32, ground (¼ inch phone jack sleeve contact). This presents no problems because the isolation through the wall transformer to the AC line is on the order of −80 dB common mode, and −60 dB differential, at 20 KHz, with the indicated FIG. 2 system connections. Therefore no significant amount of noise can pass from the power circuit to the speaker circuit considering the high impedance of the wall transformer and low impedance of the speaker. Just in case there is a failure in the Underwriters Laboratories listed wall transformer, a self resetting low current rating polymer fuse (not shown in FIG. 4) is used to connect the speaker to the measurement circuit for protection.

Alternative Embodiment

The alternative embodiment (shown physically in FIGS. 6A, 6B, and 6C) of the APM of the present invention is a durable yet light weight 19-inch wide rack-mountable enclosure, is battery operated, requires no AC mains connection, and uses little power such that battery life is extended.

Working models have been constructed of both embodiments. The circuitry is physically small and could be adapted to many packages, depending on market demands.

This embodiment has no power switch, but rather powers off automatically after approximately 30 minutes of inactivity. It is constructed using static CMOS (Complementary Metal Oxide Semiconductor) logic and well known power saving techniques to extend battery life.

Connections are made through ¼ inch phone jacks, 30, 32, 42, and 43. The functions and connections of these jacks are as described for the preferred embodiment. The APM has one-pushbutton operation with momentary pushbutton switch 203. This pushbutton awakens the unit from power off mode, sets the power threshold, and resets the attenuator to 0 dB after the power threshold has been crossed.

The display on the APM is a row of bright LED's 200 that can be read at a distance. In many cases, a musician finds on stage that he cannot hear himself playing because of the sound produced by other musicians. A quick glance at the APM reassures the musician that his rig is working as it should, preventing him from turning up his volume and unbalancing the sound mix.

Figure 6A:
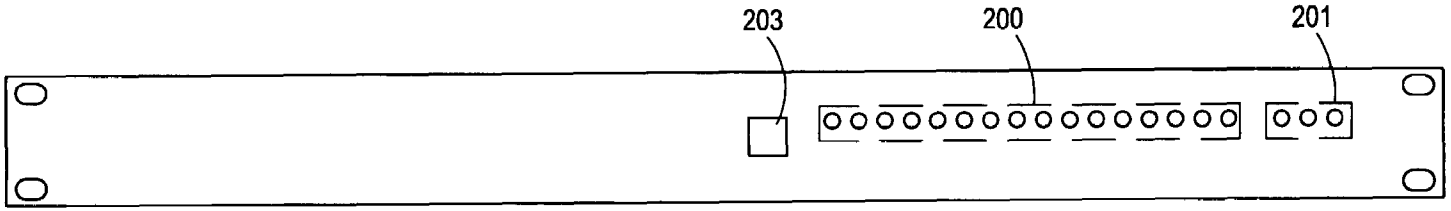
FIG. 6A is a front view of the alternative embodiment of the APM of the present invention.
Figure 6B:
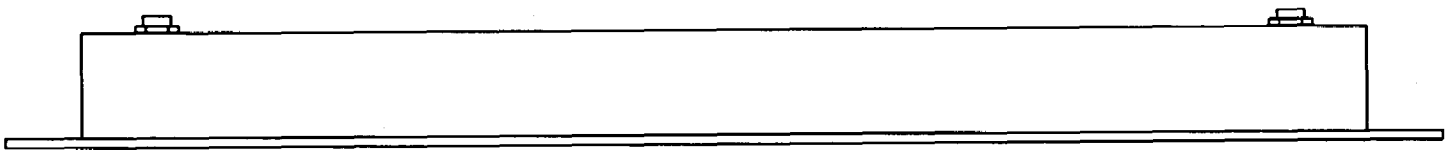
FIG. 6B is a top view of the alternative embodiment of the APM of the present invention.
Figure 6C:
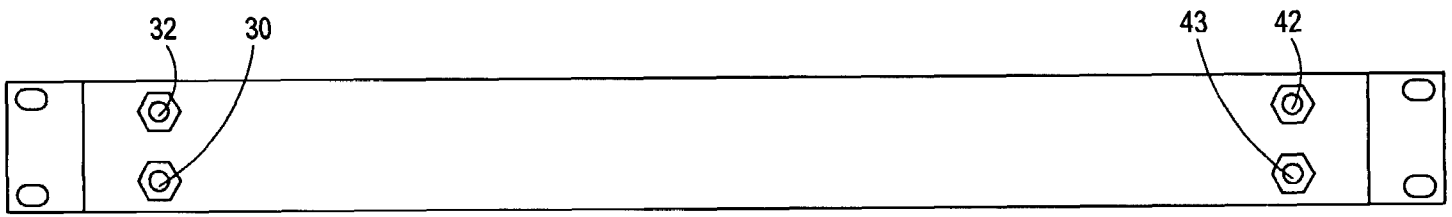
FIG. 6C is a rear view of the alternative embodiment of the APM of the present invention.

Referring to FIG. 6A, front view, the power range LED's 201 are preferably green, whereas the bar graph 200 is preferably composed of red LEDs. The power range LED's 201 are preferably located to the right of the bar graph 200, at the high power end. The low power end of the bar graph 200 is on the left in the figure. This placement gives the user a visual indication of the physical extent of the display on a dark stage because the green power range LED's 201 define the position of the highest power display position on the bar graph 200, and any amplifier power greater than 0.5 watts lights the leftmost red LED(s). Playing in various venues where the stages are different sizes, this simple placement of the green power range LED's gives the musician an instantly familiar reference when looking at the APM, even in unfamiliar surroundings or in the dark.

This embodiment is designed for low power operation. The four required AA batteries will last a working musician many months, and are installed from the rear of the APM (detail not shown). The batteries in the APM last a long time because the commercially available microprocessor is a very low power device. The APM powers off by itself after 30 minutes of inactivity, no activity being defined as either no audio or no pushbutton activity by the user. The advantage is that the musician will never get to a performance and find the APM was left on for days, batteries dead.

The display 200 consists of one moving light dot on the row of LED's, to conserve power. The position of the lit LED in the display 200 increases from left to right in FIG. 6A, as the measured power increases. This increases battery life while providing a functional APM.

The APM displays the current setpoint by blinking the LED at the user programmed power level. The flicker rate is approximately once per second, and gives the user an indication that the APM is active and that speaker protection is enabled.

Block Diagram of Alternative Embodiment

Figure 2:
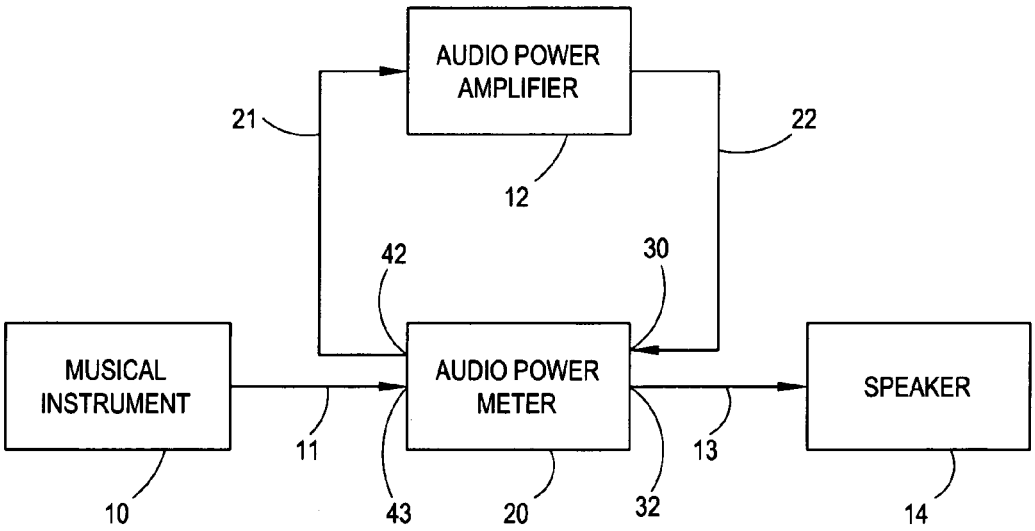
FIG. 2 is a block diagram of a typical amplifier/speaker arrangement used by musicians, with the addition of the APM of the present invention.
Figure 7:
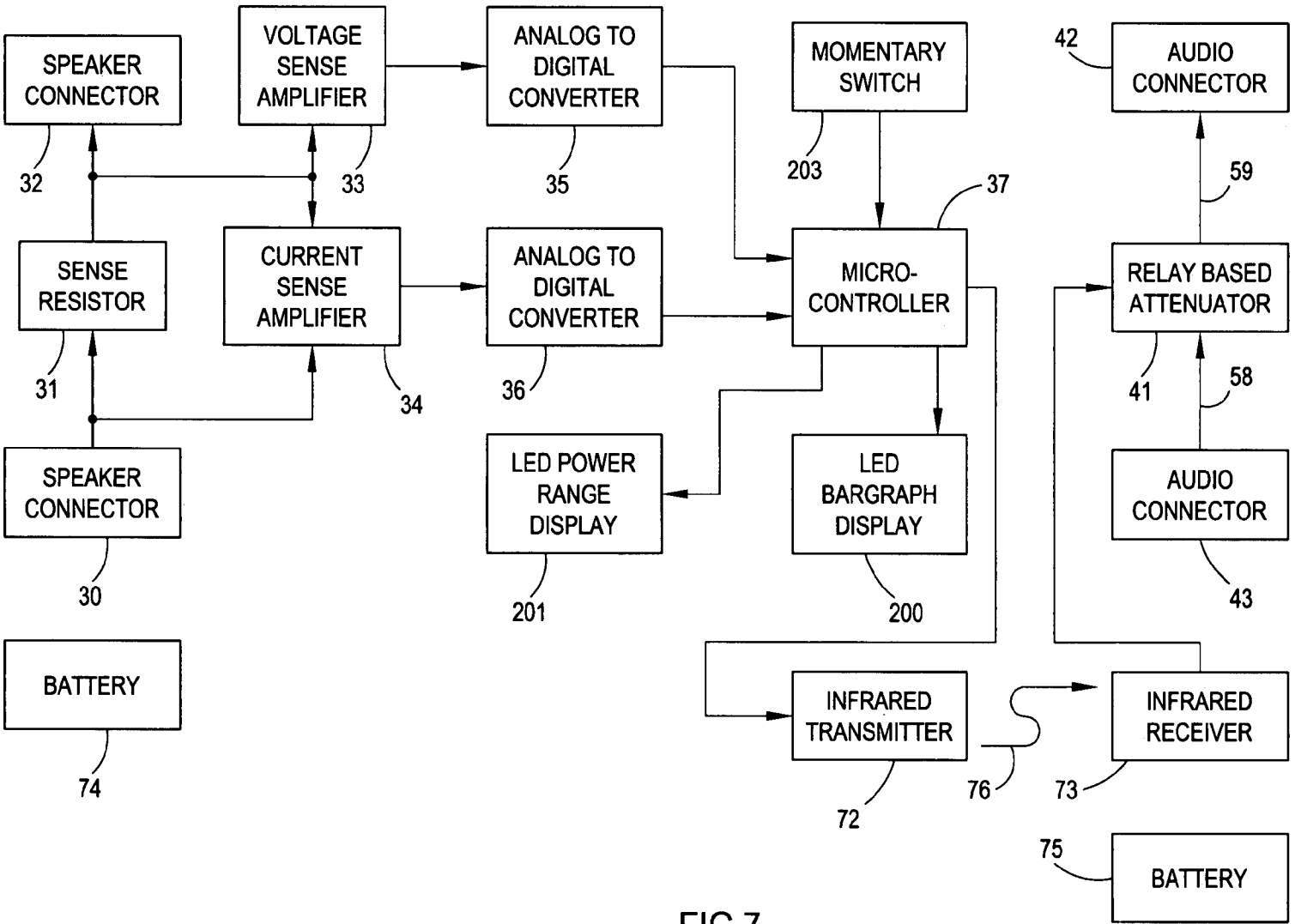
FIG. 7 is a block diagram of the internal circuit of the alternative embodiment of the APM of the present invention.

The block diagram of FIG. 7 shows the internal circuitry of the alternative embodiment APM. The external connection of the APM is as shown in FIG. 2. APM functions shown in the block diagram for the alternative embodiment are identical to those of the preferred embodiment, except as noted below; however, the entire block diagram for the alternative embodiment is shown for reference. These differences 1) enhance the input/output isolation of the alternative embodiment APM, and 2) allow it to consume less power.

The major difference between the embodiments is that instead of microcontroller 37 driving the relay coil of the relay based attenuator 41 directly, an infrared optical link is interposed to further increase the audio input/output isolation. This link consists of an infrared transmitter 72, infrared beam 76, and infrared receiver 73.

The infrared receiver 73 detects pulses from the microcontroller 37 through infrared transmitter 72. Infrared receiver 73 performs a pulse width discrimination function such that preferably a 20 ms infrared pulse sets the latching relay based attenuator 41, attenuating the audio path preferably about 20 dB. A preferably short, 500 us pulse from the microcontroller 37 through infrared transmitter 72 resets the latching relay based attenuator 41, restoring the input audio path to 0 dB attenuation. A latching relay is used in the alternative embodiment because, once set to either state, it requires zero power to maintain that state.

Since there are powered circuits on both sides of the infrared link, two sets of batteries are needed to maintain maximum isolation. The embodiment uses CMOS logic and components that run at 3VDC, so two sets of two 1.5V AA batteries are used, 74 and 75.

The path of infrared beam 76 can be as long as practical, even consisting of a line of sight or reflective path between two separate enclosures, to accomplish higher isolation or take advantage of more convenient mounting options for the low level signal circuitry and high power speaker signal circuitry. In the alternative embodiment, the path is about 10 cm in length within the enclosure shown in FIG. 6A.

Schematic of Alternative Embodiment

The alternative embodiment has several differences from the preferred embodiment, pertaining to optical isolation of the relay control signal, and the power supply of the APM. These differences are shown in FIG. 5H through FIG. 5K and are described below.

The power supply of the alternative embodiment uses commonly available 1.5V batteries. To preserve isolation between the low level and speaker signals flowing through the APM, two sets of batteries are used to power the respective electronics sections independently. In the alternative embodiment, across all schematic subsections, the symbol VCC represents a voltage of 3.0 volts DC, or two 1.5V DC batteries connected in series.

Figure 5H:
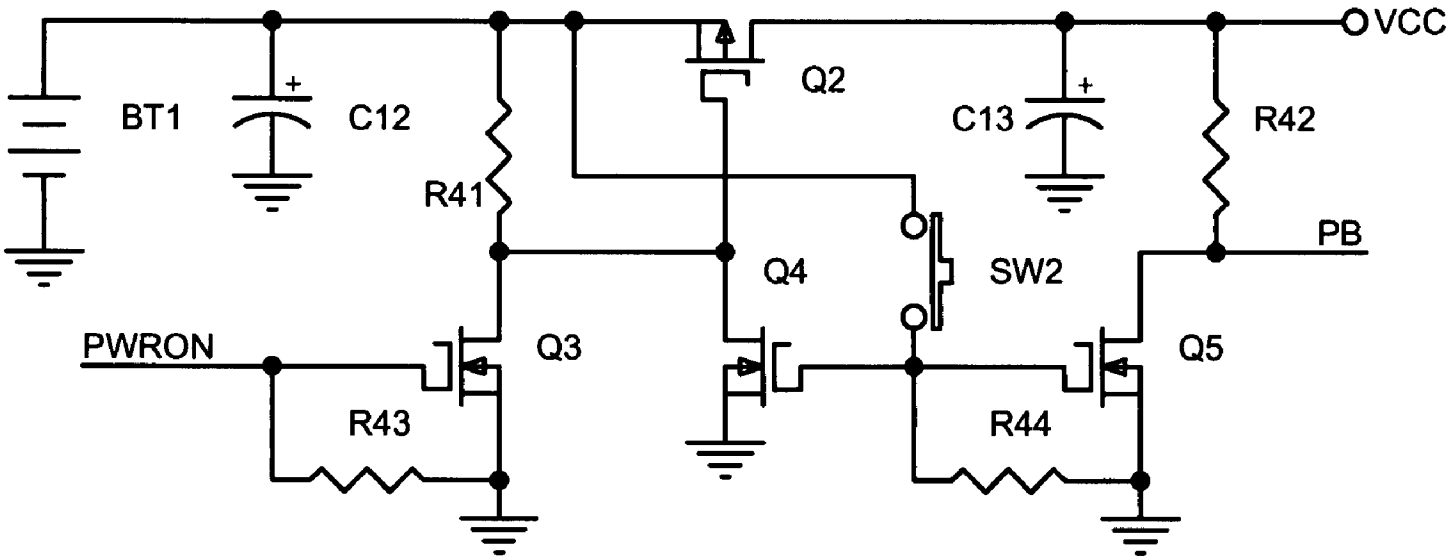

The power supply for the main section containing the microcontroller is shown in FIG. 5H. A pass transistor Q2 is the main power conducting component. It is turned on by either of two events. The first is depression of a switch SW2. (Switch SW2 in this embodiment functionally takes the place of switch SW1 in FIG. 5A in the preferred embodiment.) Depression of switch SW2 turns on transistors Q4 and Q2. Transistor Q4 turns on, pulling the gate of Q2 to ground, turning on Q2 as well. This connects 3V DC battery BT1 to VCC, powering the microcontroller (IC1 in FIG. 5A) and all other circuitry connected to signal VCC.

A second event can turn on transistor Q2. Once the microcontroller is powered, it sets signal PWRON HIGH, which turns on transistor Q3, forcing transistor Q2 to remain on regardless of whether the user presses pushbutton SW2. This whole process, from the initial depression of SW2 to the setting of PWRON HIGH, takes only a few milliseconds. The microcontroller can turn off its own power supply and return the APM to a low power state by setting PWRON LOW.

The pushbutton SW2 is also used by the user to set the power threshold, among other functions previously described. The microcontroller senses depressions of pushbutton SW2 through transistor Q5 and signal PB. When the pushbutton is depressed, signal PB goes LOW. Otherwise, it is pulled HIGH by resistor R42. Signal PB is connected to the microcontroller at pin P3.0 (not shown).

A resistor R43 ensures that the PWRON signal stays LOW when the power to the microcontroller (signal VCC) is off. A resistor R41 ensures that transistor Q2 turns OFF by default when not being turned on by transistor Q3 or Q4, whose drains are connected in a WIRED-OR configuration. Likewise, a resistor R44 ensures that transistors Q5 and Q4 turn off when SW2 is not depressed. These components establish the default states for the transistor switches in this circuit.

Filter capacitors C12 and C13 serve to filter out any high frequency noise from the power signals.

Signal PWRON is not shown on the microcontroller IC1 in FIG. 5A, but would typically be connected to a pin such as P1.3.

Figure 5I:
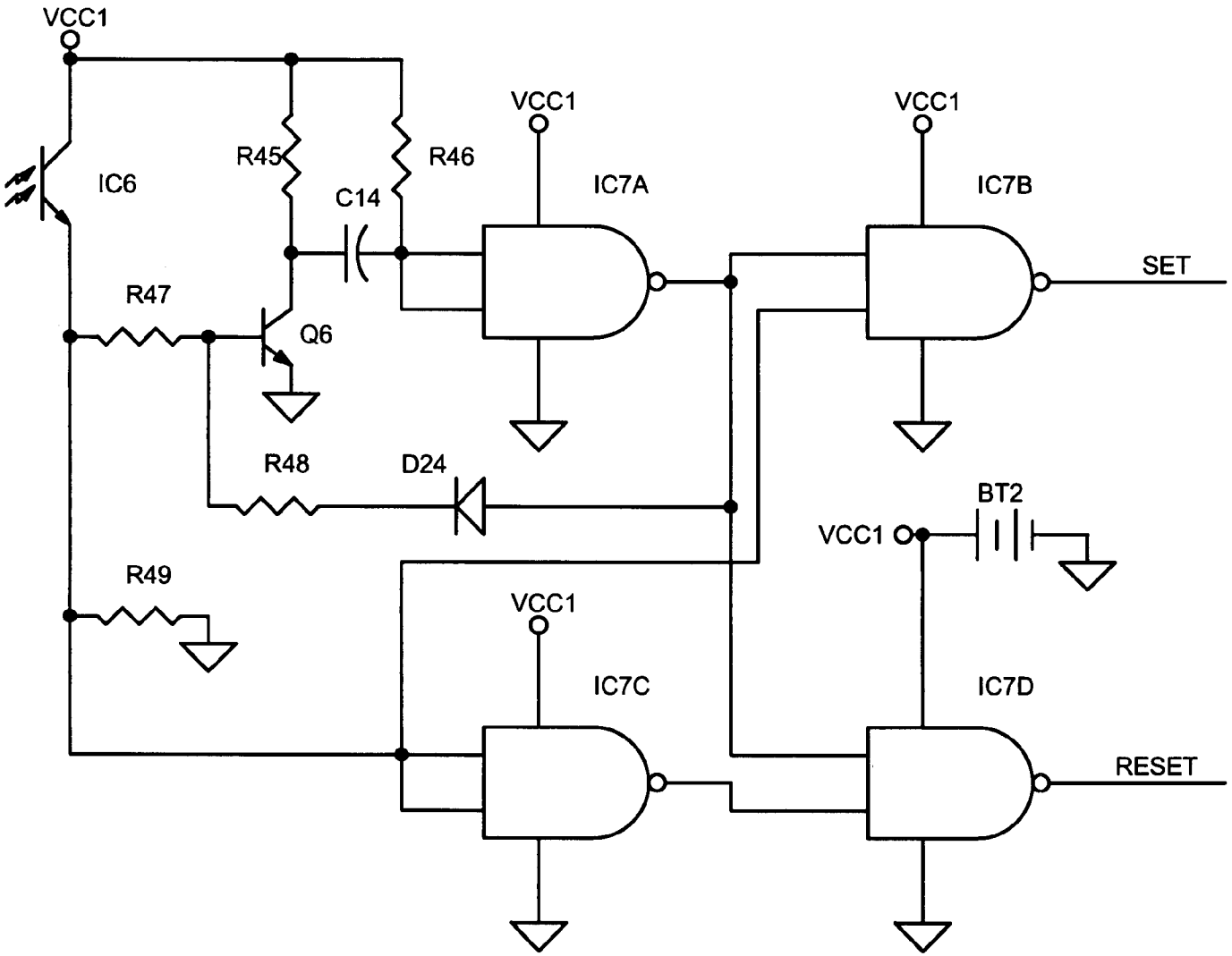
Figure 5J:
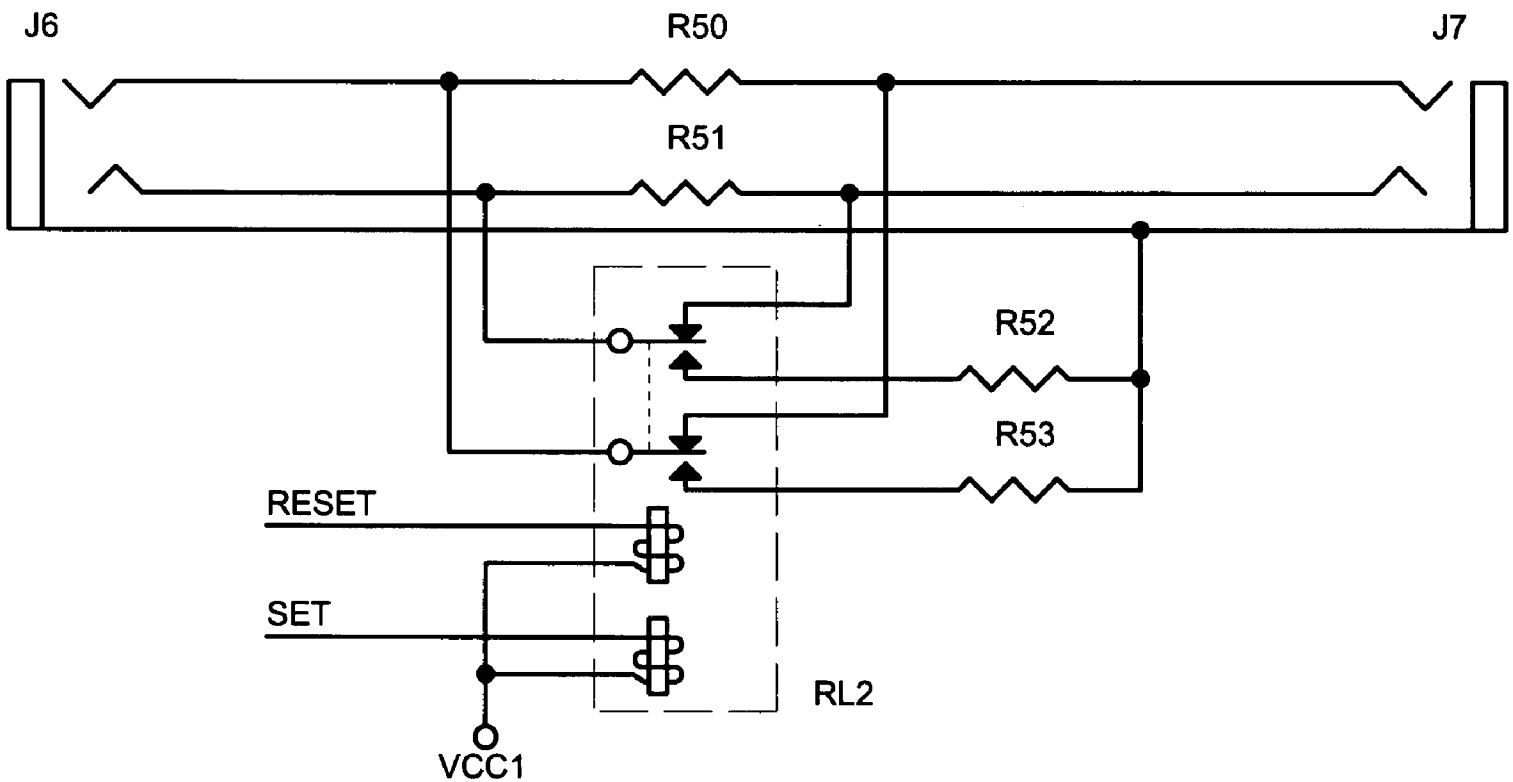
Figure 5K:
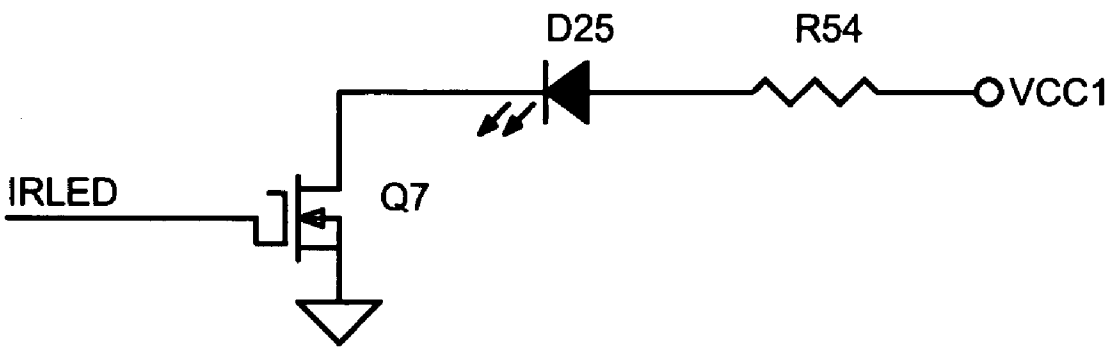

The infrared link from the microcontroller IC1 is shown in FIG. 5K. This is composed of a transistor switch Q7, an infrared LED D25, and a current limiting resistor R54. Signal IRLED is connected to the microcontroller IC1 at pin P1.4 (not shown). This signal goes HIGH to initiate infrared radiation from the LED D25.

The infrared light is received and processed by the circuit shown in FIG. 5I, which discriminates between two widths of pulses from the microcontroller IC1. It is powered by 3V DC battery BT2, providing power through signal VCC1. This circuit uses a low power quad NAND logic gate IC7A-IC7D. Initially, with no incident infrared light, the inputs of IC7A are HIGH, and its output is LOW. The inputs of IC7B and IC7C are LOW, so the outputs of IC7B and IC7C are HIGH. The input of IC7D sourced by IC7A is LOW, making the output of IC7D HIGH. In this condition, the only current drawn by the circuit is the static leakage of IC7A-IC7D, and the leakage of two off-state transistors, described below. This amounts to only about a microamp.

Gate IC7A and its associated components serve as a monostable multivibrator as described following. The infrared phototransistor IC6 is positioned in line of sight with previously described infrared LED D25 (shown in FIG. 5K). Light falling on phototransistor IC6 causes its resistance to decrease, causing the voltage across a resistor R49 to increase. (All resistors in FIG. 5I are 10K ohms unless noted otherwise.) A transistor Q6 is turned on by this increase in voltage through a base current limiting resistor R47. The lowered resistance of transistor Q6 charges a capacitor C14 (typically 100 nanofarads) to voltage VCC1 through a resistor R46 (100K ohms). This action causes the output of IC7A to switch HIGH for a duration of about 10 milliseconds (the time constant of C14 and R46). A resistor R48 and a diode D24 serve as positive feedback from the output of IC7A, forcing the transistor Q6 on for the full duration of the 10 millisecond pulse, and preventing the removal of infrared light from phototransistor IC6 from terminating the pulse early.

While the 10 millisecond pulse is active (IC7A output HIGH), gates IC7B and IC7D have one input each driven HIGH. The other inputs of IC7B and IC7D are driven by the true and inverted signal received by infrared phototransistor IC6, the inversion being provided by IC7C. Gates IC7B and IC7D provide SET and RESET signals to a dual-coil latching relay RL2 (shown in FIG. 5J). The width of the infrared light pulse from microcontroller IC1 determines whether signal SET or RESET is activated (set LOW) as follows.

Figure 10A:
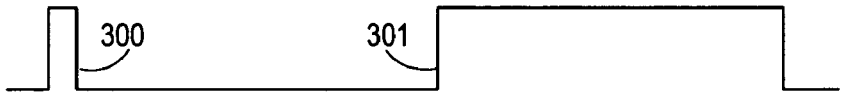
FIG. 10A through FIG. 10E are timing diagrams pertaining to the infrared signaling method.
Figure 10B:
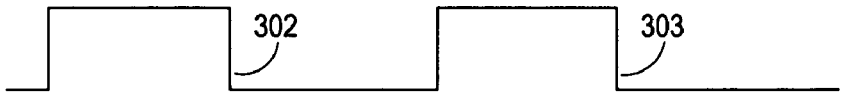
Figure 10C:
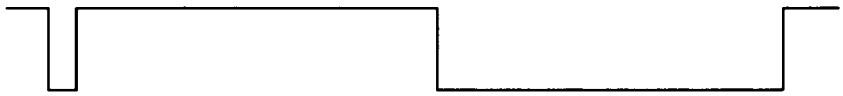
Figure 10D:
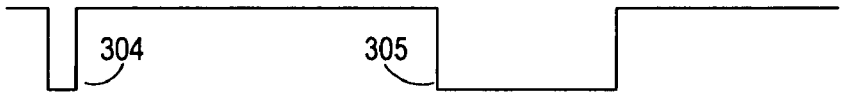
Figure 10E:
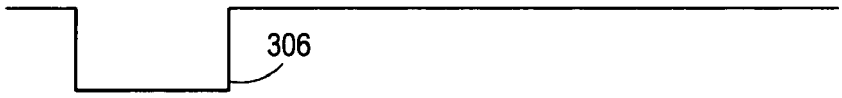

Refer to the timing diagram in FIG. 10A through FIG. 10E. FIG. 10A represents the infrared light pulses, HIGH being light present. Two pulses are shown, a 500 microsecond pulse 300 and a 20 millisecond pulse 301 (not to scale). FIG. 10B represents the output of IC7A, which is a 10 millisecond pulse 302. FIG. 10C represents the output of IC7C, which is the inverse of the infrared light pulse shown in FIG. 10A. FIG. 10D represents the output of IC7B, signal SET. FIG. 10E represents the output of IC7D, signal RESET.

For a short (500 microsecond) infrared light pulse 300, the output of IC7A goes HIGH for 10 milliseconds as previously described (pulse 302). The SET signal also goes LOW for 500 microseconds, which is the coincident period between the two inputs of gate IC7B (pulse 304). The SET relay coil does not respond to this short pulse 304, however. Gate IC7D produces a pulse 306 (the signal RESET) with width of 10 milliseconds minus 500 microseconds, or 9.5 milliseconds, which is sufficiently wide to cause the latching relay to change state.

For a long (20 millisecond) infrared light pulse 301, the output of IC7A goes HIGH for 10 milliseconds as previously described (pulse 303). The SET signal also goes LOW for 10 milliseconds (pulse 305), which is the coincident period between the two inputs of gate IC7B. This pulse is sufficiently wide to cause the latching relay to change state. Gate IC7D produces no pulse on the signal RESET during this time.

Signals SET and RESET control the latching relay RL2 shown in FIG. 5J. This relay is a latching type because, once set or reset, it draws zero power, and this is important for a battery operated product. The configuration of the attenuation resistors is identical to that shown in FIG. 5E, described above.

Note that the VCC1 and ground (denoted with a small triangle symbol) signals shown in FIG. 5I through FIG. 5J are separate from the VCC and ground signals in the rest of the schematic. There is no electrical connection, but only an infrared connection, between these separate circuits. This enhances isolation between the low level and speaker signals flowing through the APM.

Software Description

Figure 8:
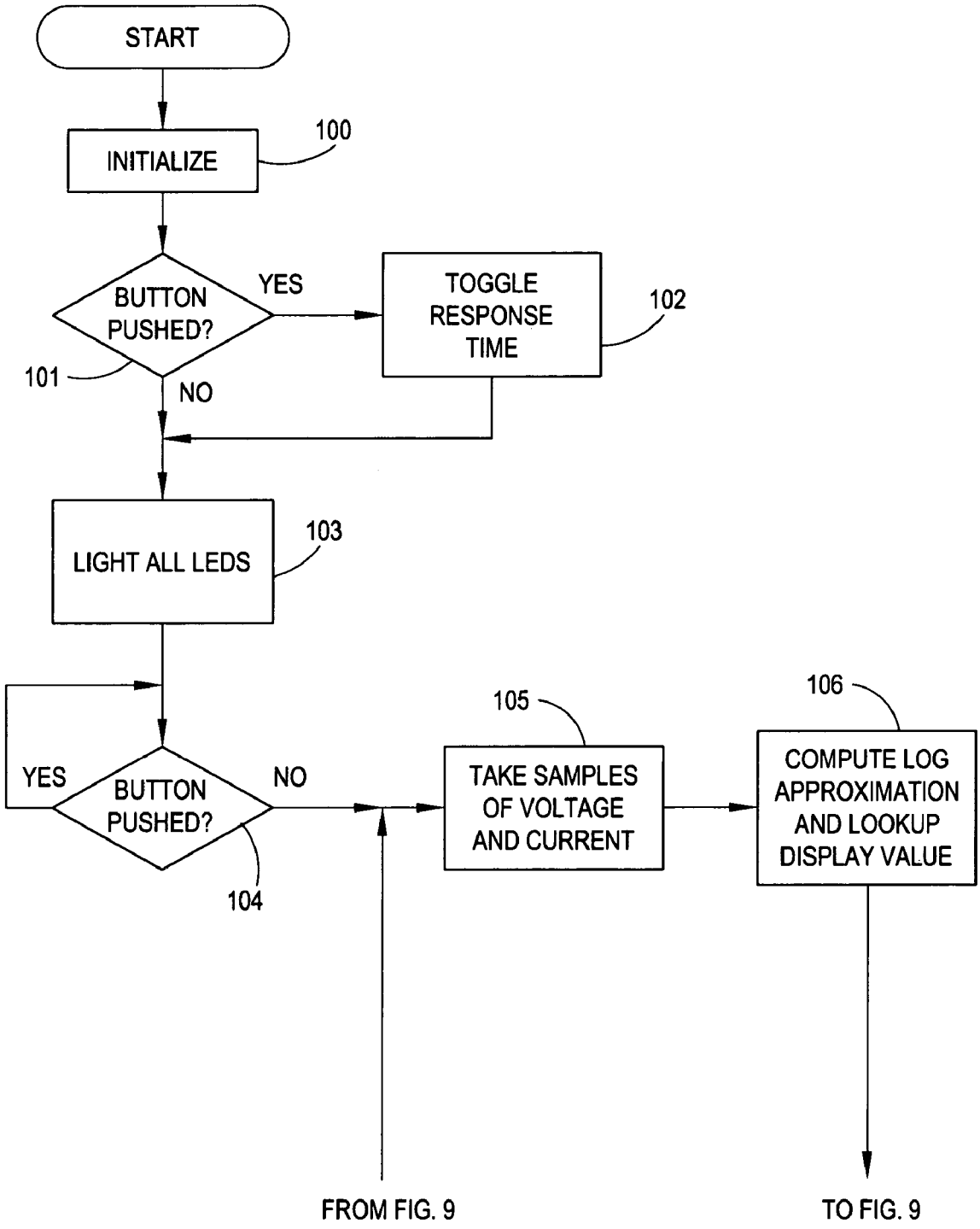
FIG. 8 is the first page of the flowchart representing the software that operates the APM of the present invention.
Figure 9:
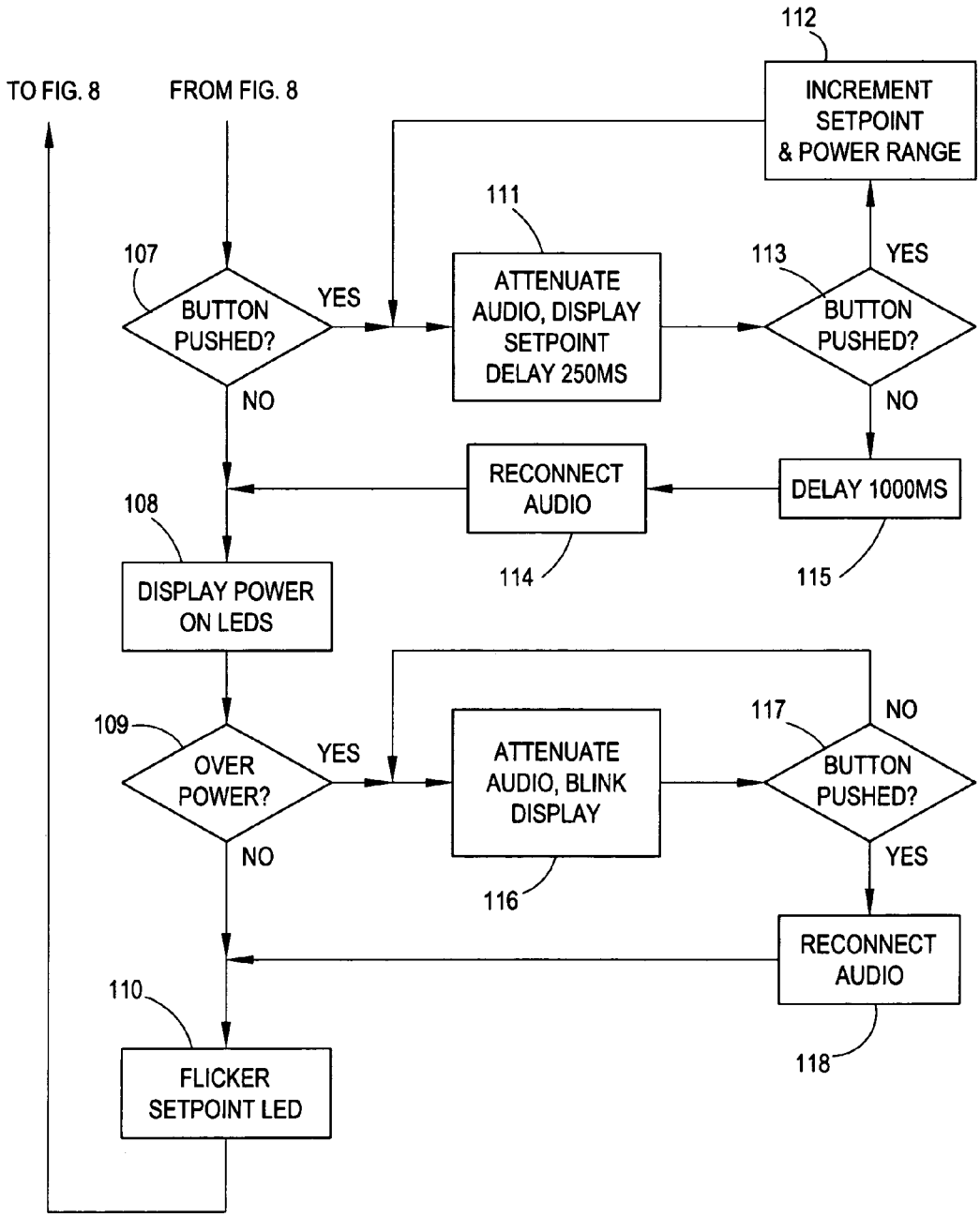
FIG. 9 is the second page of the flowchart representing the software that operates the APM of the present invention.

The software of both embodiments of the APM is presented in flowchart form in FIG. 8 and FIG. 9. The software of the APM is implemented in a commodity microcontroller whose general function is well known to persons practicing the art.

An initialization block 100 initializes the hardware and memory of the APM so it is ready to make measurements. This consists of writing values to the internal peripherals of the microcontroller per its data sheet specification.

The flowchart in FIG. 8 shows that blocks 101 and 102 allow the user to hold the pushbutton during power up of the APM to toggle the response time between fast and slow. The fast setting selects preferably about 40 ms per power measurement. The slow setting averages the power samples with the formula $SAMPLE_N=((SAMPLE_{N-1}\cdot 5)+P)/6$, where P is the power measured in the most recent 40 ms period.

The next action of the program is to light all LEDs on the APM to ensure they are working (as observed by the user). This occurs in block 103. The LEDs in the bar graph are lit sequentially. The rate of lighting of the LEDs in the bar graph is proportional to the fast or slow response time selected by the user, as an indication of the current setting.

Block 104 waits for the user to release the front panel pushbutton before falling into the main loop.

The main loop of the program encompasses blocks 105 and 106 in FIG. 8 and all the blocks in FIG. 9.

Block 105 takes preferably about 800 samples each of the voltage and current using the analog to digital converters at preferably about a 20 KHz rate. This amounts to a total 40 ms measurement period.

Block 106 computes the appropriate display value corresponding to the measured voltage and current, and saves it for later display by block 108. The details of the calculation are given below, after this description of the flowchart.

Referring to FIG. 9, block 107 determines if the user is pressing the pushbutton. If so, block 111 changes the state of the relay to attenuate the audio path by preferably about 20 dB. It also displays a single solidly lit LED at the current setpoint value, for the user's information. A preferably short 250 ms delay is also performed to allow the setpoint to be visible for a minimum period of time.

After the delay is complete, block 113 decides whether the pushbutton is held depressed. If so, block 112 increments the setpoint, updating the display to show the newly increased value. If the setpoint increases beyond the end of the bar graph, the bar graph goes blank for one 250 ms period (as timed by block 111), indicating that the over power protection feature is disabled. If the pushbutton is still depressed, the power range is changed to the next of the three possibilities (low, medium, high power) and the setpoint starts from the lowest end of the LED bar graph, moving up every 250 ms. In this way, the user can select the power range and over power threshold (or no threshold at all).

When the user releases the pushbutton, block 113 determines this. Block 115 delays preferably about 1000 ms to allow the user to see the setpoint selected, then block 114 reconnects the audio through the relay for 0 dB attenuation and the main loop continues with block 108.

The purpose of attenuating the audio when the user presses the pushbutton is to allow him to test the attenuation function and audio path without having to produce a power overload. This is done with a quick depression of the pushbutton.

Block 108 sets the LED bar graph to reflect the value computed by block 106. When power has caused the LED bar graph to light, and then the power is abruptly removed, block 108 causes the bar graph to step down toward zero at a rate of about 100 ms per step instead of extinguishing instantly. This provides a more persistent display for the user, without affecting the response time of the speaker protection logic in block 109. Upon application of increasing power to the APM, the LED bar graph lights at the computed power, without any delay above the user selectable response time.

If the computed power is over the set power threshold in block 109, then block 116 directs the relay to attenuate the audio and blink the display. The bar graph is blinked alternately half on, half off at about a 2 Hz rate until block 117 determines that the pushbutton has been pressed. At that time, block 118 immediately restores the low level signal path to 0 dB attenuation. This loop could be modified to allow a short timeout (on the order of a few seconds) to automatically reconnect the audio path, as has been described previously as a functional option. This modification is not shown on the block diagram.

Block 110 flickers the LED at the current power threshold setpoint, but only if no power is flowing through the APM. This flickering allows the user to see that the APM is active and protecting the speaker, and at what power level. Block 110 exits back to block 108 in FIG. 8 to complete the main loop.

Power Computation Details

Next examined are the details of power computation and display in flowchart block 106.

The APM of the present invention is an audio power meter that computes power in a mathematically efficient manner, and its algorithm eliminates the need for a costly, power inefficient, electromagnetic interference radiating DSP (digital signal processor).

The formula for power computation is:

$$P = \frac{1}{T}\int_0^T (vi)dt$$

where v and i are the instantaneous voltage and current in the circuit, and T is the measurement period. The APM uses a discrete version of this formula:

$$P = \frac{1}{n\Delta t}\sum_1^n (vi)\Delta t$$

where n equally spaced samples are taken over the period T, making $\Delta t = T/n$. (In the disclosed embodiments, T=40 ms, but this is immaterial to the algorithm.) This numerical method is a well established part of the prior art, and is described in U.S. Pat. No. 4,240,149, which issued on Dec. 16, 1980 to Fletcher et al., the disclosure of which is incorporated herein by reference.

The requirement is to display the logarithm of the power on the LED bar graph so that the user has a display calibrated similarly to logarithmic amplitude response of the human ear. Therefore, it is ideally desired to compute log(P) and then decide which LED to illuminate as a function of that value. However, this is computationally intensive on an inexpensive microprocessor. The following optimization is made:

$$\log(P) = \log\left(\frac{1}{n\Delta t}\sum_1^n (vi)\Delta t\right) = \log\left(\frac{1}{n}\sum_1^n (vi)\right)$$
$$= \log\left(\sum_1^n (vi)\right) - \log(n)$$

The APM measures the voltage and current samples as outlined above, and computes the sum of the voltage-current products efficiently using low power 16-bit multiplication hardware in the microcontroller. This quantity, $$\sum_1^n (vi),$$

is called the summed power. From the optimization above, it is seen that the logarithm of the actual audio power is proportional to the logarithm of the summed power minus a constant. This eliminates the need to divide by n.

In the disclosed embodiments, preferably n=800. Note that the summed power is quite a large number, even for the lowest power levels that the APM registers (preferably 0.5 watts), whereas log(n) is typically small by comparison, so it can be ignored, resulting in the following approximation:

$$\log(P) \approx \log\left(\sum_1^n (vi)\right)$$

Regarding the logarithm, the base is theoretically not important. That said, a convenient base is chosen to be 2, since the computer does binary computations easily. Instead of taking a full binary logarithm using floating point mathematics, which is very expensive in terms of execution time, hardware cost and power consumption, an examination of the most significant bits of the summed power value yields a satisfactory result. This is a compromise which matches the resolution of the computation to the resolution of the display means. A table of exponentially increasing bit mask values is used. (Note that looking up a linearly increasing value in a table indexed by an exponentially increase value effectively performs a logarithm.) From the actual table of a prototype of the APM, a portion follows:

| Table Index | Bit Mask | Power (watts) | LED Index |
|---|---|---|---|
| 0 | 0x100000 | 0.54 | 0 |
| 1 | 0x140000 | 0.68 | 0 |
| 2 | 0x180000 | 0.81 | 0 |
| 3 | 0x1c0000 | 0.95 | 1 |
| 4 | 0x200000 | 1.09 | 1 |
| 5 | 0x280000 | 1.36 | 1 |
| 6 | 0x300000 | 1.63 | 2 |
| 7 | 0x380000 | 1.90 | 2 |
| 8 | 0x400000 | 2.17 | 2 |
| 9 | 0x500000 | 2.71 | 3 |
| 10 | 0x600000 | 3.26 | 3 |
| 11 | 0x700000 | 3.80 | 3 |
| 12 | 0x800000 | 4.34 | 4 |
| 13 | 0xA00000 | 5.43 | 4 |
| 14 | 0xC00000 | 6.51 | 4 |
| 15 | 0xE00000 | 7.60 | 5 |
| 16 | 0x1000000 | 8.68 | 5 |
| 17 | 0x1400000 | 10.85 | 5 |
| 18 | 0x1800000 | 13.02 | 6 |
| 19 | 0x1C00000 | 15.19 | 6 |
| 20 | 0x2000000 | 17.36 | 6 |
| 21 | 0x2800000 | 21.70 | 7 |
| 22 | 0x3000000 | 26.04 | 7 |
| 23 | 0x3800000 | 30.38 | 7 |
| 24 | 0x4000000 | 34.72 | 8 |
| 25 | 0x5000000 | 43.40 | 8 |
| 26 | 0x6000000 | 52.08 | 8 |
| 27 | 0x7000000 | 60.76 | 9 |
| 28 | 0x8000000 | 69.44 | 9 |
| 29 | 0xA000000 | 86.81 | 9 |

The Table Index column merely numbers the rows in the table. The bit mask column is used to determine which of the most significant of three bits are set in the summed power value. (The power is listed in the table above, but is not stored in the microcontroller because that value is only needed as a reference for the user, and is rather printed on the front panel of the APM.) The LED Index column indicates which LED to illuminate.

Heep (U.S. Pat. No. 5,341,089, which issued on Aug. 23, 1994) teaches a table based algorithm used to convert voltages to dBm (decibels with a reference of 0 dBm=1 milliwatt measured across a specified impedance). The method here is different in that the APM does not look up a voltage, current, or power in the table. Rather, it examines the most significant several bits of a quantity to approximate the logarithm to the base two of the quantity. The table merely correlates this to a display stimulus. Also, in the table fragment above, note the large number of zeros carried in each Bit Mask value. These may be dropped, allowing significant reduction in size of the table. The bit mask computation is more efficient than comparison of large binary voltage, current, or power values.

An LED can be illuminated by one or more entries in the table to implement various power ranges conveniently, and the LED Index column facilitates this. For example, if each of the 16 LEDs in the bar graph correspond to three consecutive entries in the table (as in the above example), a certain maximum range results. If each of the 16 LEDs in the bar graph correspond to four consecutive entries in the table, a larger maximum power range results, given that the table entries are distributed among all LED display elements.

As an example of using the table, assume the summed power value is 0x003F4A774 ("0x" representing hexadecimal notation). A simple program loop that scans the table comparing this value against the table entries quickly shows that the highest power represented by this summed power value (0x003F4A774) is 0x003800000 at Table Index 23, corresponding to a power of 30.38 watts. The corresponding LED Index is 7 and that LED would be lit as a result.

More generally, the table scanning algorithm works as follows:

1. Determine the most significant bit in the summed power value that is a 1. Assign variable N this value (counting from zero as the least significant bit).

2. Scan the table from the lowest power entry for the first bit mask value that has bit N set. This is Table Index M.

3. For Table Indexes M+3 through M (in that order), logically AND the Bit Mask table entry with the summed power value. If the result of the AND operation equals the Bit Mask table entry, read the Power and LED Index from the table and terminate the algorithm.

The power values are not exactly log-linear vs. the LED Index due to the granularity of the three bit masking process, but the linearity is sufficient for this application. A simple spreadsheet regression analysis of the full lookup table shows a correlation coefficient of greater than 0.999, indicating that the three bit logarithm approximation is quite log-linear. This analysis is performed by taking the logarithm of the Power values in the full table, an excerpt of which appears above, then performing a regression analysis to determine how well that data corresponds to a straight line.

This simple algorithm is executed on an embedded processor running at about 5 MHz, consuming less than one milliamp of supply current. This low power performance is not possible with a high speed DSP device performing an explicit power computation.

Calibration

The APM of the present invention is calibrated by connecting a predetermined resistive calibration load (for example, 8.0 ohms) and speaker drive signal (for example, 50.0 watts), then momentarily shorting to signal ground a test point on the circuit board (test point TP1 in FIG. 5A). The program in the APM then measures the AC voltage and current, compares them to the expected values (voltage=$(50*8)^{1/2}$=20V RMS, current=$(50/8)^{1/2}$=2.5 A RMS). It computes and saves calibration factors which are applied to each measurement before display. This calibration method compensates for amplifier and digitizer gain errors.

Operating the Audio Power Meter

The user operates the APM of the present invention by first connecting it according to FIG. 2. Musicians are accustomed to such equipment connections.

The APM is powered either by connecting the AC power to the APM (preferred embodiment), or installing batteries and pressing the single front panel pushbutton (alternative embodiment). The preferred embodiment front view is shown in FIG. 3A, and the pushbutton 203 is indicated. FIG. 3B shows the rear view of the preferred embodiment, containing the power connector 204. The alternative embodiment front view is shown in FIG. 6A, and the pushbutton 203 is indicated.

Immediately after being powered, the APM lights all LEDs on the main LED bar graph display 200 and power range display 201 briefly to indicate that they are all functional. The rate of illumination is dependent upon the currently selected response time, fast or slow. The user may hold the pushbutton 203 during power up to toggle the response time between fast and slow.

To set the power threshold, the user presses the pushbutton 203. The LED bar graph display 200 lights at the current setting. If the user holds the pushbutton, the displayed threshold increases. The user releases the pushbutton 203 when the desired full scale power range and power setting is achieved. The display 200 continues showing the set value for 1000 ms before reverting to normal operation. The power range display 201 always indicates the current power range.

In normal operation, the power meter measures and displays the power flowing through it. The audio signal path is not attenuated. When the measured power is zero, the set point is indicated by a flickering LED on the main power display 200.

When a power overload occurs, the audio signal path is attenuated and the main power display 200 is logically divided into two halves which blink alternately at a rate of approximately 2 Hz. The user must then press pushbutton 203 to restore the attenuator to 0 dB attenuation and restore the display to normal operation.

In order that the user may test the attenuation operation of the APM, the attenuator is engaged when the user presses the pushbutton 203 to set the power threshold. If the pushbutton 203 is pressed only briefly, the attenuator is engaged and the power threshold is displayed on the main power display 200, but the threshold is not changed. The APM reverts to normal operation after 1000 ms.

CONCLUSION

The audio power meter of the present invention offers several advantages to the musician:

1. The APM is optimized to the musical instrument amplifier application and provides exactly the features needed by a working musician, including speaker and consequent amplifier protection from power overloads.

2. The APM encourages consistent performances by giving the musician a calibrated visual indication of exactly how much power is being used in the performance.

3. Since musicians consider the amplifier and speaker part of their tone-producing toolset, they tend to push the limits of the equipment in order to accomplish better performances. The APM allows the musician to do this without fear of equipment damage.

4. Since musicians play in many venues with widely varying acoustics, a calibrated reference is needed to display exactly how much power is being used in the performance. The APM provides this.

5. The APM is easy to use and requires no education or computation (such as compensating for various speaker impedances).

6. The APM gives the user a visual and audible indication of speaker protection.

7. The APM measures power in three ranges, suitable for a wide range of musician applications, from small clubs to concert halls.

8. The APM measures power in terms of averaged instantaneous power, which is most directly related to the amount of work being performed by a speaker and amplifier.

9. The APM is insensitive to the type of speaker used, its impedance, and the amplifier characteristics, up to the designed-for power limit for a particular embodiment.

10. In normal operation, the APM does not change the tone or amplitude of the signals passing through it.

11. Use of the APM conveys all its benefits without the need for modification of vintage, antique, or otherwise valuable musical equipment.

12. The APM prevents damage to possible irreplaceable equipment.

13. The APM prevents embarrassing disruptions of performances due to equipment failure.

14. The APM can be operated from the AC line or from batteries, depending on the application.

15. The design of the APM ensures proper input/output isolation for the protected amplifier and speaker, to prevent oscillation. The presented embodiments demonstrate exceptional isolation.

16. The APM gives the user a choice of slow or fast response time, which the user selects to tailor the APM's operation to his playing style.

17. The APM indicates to the user the current power threshold visually.

18. The APM computes the power using an efficient but accurate logarithm approximation software technique.

19. The APM does not switch, or disconnect even briefly, the speaker signal between the speaker and amplifier.

20. No connection to or control of the AC power input of the amplifier is required.

21. The APM uses a mechanical relay and passive resistors to implement an attenuator that introduce practically zero noise into the signal path.

The specific configuration of the embodiments discussed should not be construed to limit implementation of this invention to those embodiments only. The techniques outlined are applicable to embodiments in other physical formats, using different power sources, using single or multiple amplifiers, using single or multiple speakers, using other display technologies, colors or formats, using other software algorithms, and using other user interfaces. The APM is functional with any audio program source, including electric instruments, sound collected by a microphone, voices, recorded music and speech, and the broad inclusive range of sounds and instruments used by musicians. The APM could also be built into an amplifier, speaker enclosure, carrying case, or equipment rack. The APM can also be profitably used without the speaker protection feature. The APM can also be used to protect the speaker by not monitoring the power going into the speaker, but rather the sound pressure level coming out of the speaker, with a suitable microphone, either inside or outside the speaker enclosure. Therefore, the scope of the invention should be determined not by the embodiments illustrated, but by the appended claims and their legal equivalents.

What is claimed is:

1. An audio power meter connectable to a musical instrument generating an audio signal, an audio power amplifier generating an amplified audio signal and a speaker being responsive to the amplified audio signal provided thereto by the audio power amplifier, which comprises:

a current sense resistor, the current sense resistor being interposed between the audio power amplifier and the speaker and having the amplified audio signal pass therethrough and generating a voltage thereacross in response to the amplified audio signal passing therethrough;

a current sense amplifier being responsive to the voltage across the sense resistor and generating an amplified current sense signal in response thereto;

a voltage sense amplifier being responsive to the voltage of the amplified audio signal provided to the speaker and generating an amplified voltage sense signal in response thereto;

a first analog to digital converter, the first analog to digital converter being responsive to the amplified voltage sense signal and generating a digital voltage data signal in response thereto;

a second analog to digital converter, the second analog to digital converter being responsive to the amplified current sense signal and generating a digital current data signal in response thereto;

a microcontroller, the microcontroller being responsive to the digital voltage data signal and the digital current data signal and generating a power level signal and a control signal in response thereto;

a first bar display, the first bar display including a plurality of separately illuminatable segments arranged sequentially to reside along a first axis, the first axis being one of linear and curvilinear, each segment of the plurality of separately illuminatable segments being responsive to the power level signal of the microcontroller and being selectively illuminated in response thereto, the segments being illuminated defining a portion of the first bar display, the portion of the first bar display defined by the illuminated segments having a length, the length of the portion being proportional to the average power of the amplified audio signal outputted by the audio power amplifier; and an attenuator circuit, the attenuator circuit being connectable to the musical instrument and the audio power amplifier and having the audio signal pass therethrough, the attenuator circuit being responsive to the control signal and selectively attenuating the audio signal provided to the audio power amplifier in response thereto.

2. A method of measuring the average power of an amplified audio signal outputted by an audio power amplifier in response to an audio signal generated by a musical instrument and provided to the audio power amplifier, the amplified audio signal being provided to a speaker, which comprises the steps of:

passing the amplified audio signal through a current sense resistor and thereby generating a voltage thereacross;

amplifying the voltage across the current sense resistor and generating an analog amplified current sense signal in response thereto;

sensing the voltage of the amplified audio signal provided to the speaker and generating a sensed voltage in response thereto;

amplifying the sensed voltage of the amplified audio signal and generating an analog amplified voltage sense signal in response thereto;

sampling and converting the analog amplified voltage sense signal to a digital voltage data signal;

sampling and converting the analog amplified current sense signal to a digital current data signal;

processing the digital voltage data signal and the digital current data signal and generating a power level signal and a control signal in response thereto, the power level signal corresponding to the average power of the amplified audio signal outputted by the audio power amplifier, the control signal corresponding to a threshold average power level of the amplified audio signal;

illuminating at least one segment of a plurality of segments of a first bar display in response to the power level signal, the number of illuminated segments of the plurality of segments being proportional to the average power of the amplified audio signal outputted by the audio power amplifier; and selectively attenuating the audio signal provided to the audio power amplifier in response to the control signal.

3. A method of measuring the average power of an amplified audio signal as defined by claim 2, which further comprises the steps of:

activating a user activatable switch; and illuminating at least one segment of a plurality of segments of a second bar display in response to the activation of the user activatable switch, the at least one illuminated segment of the plurality of segments of the second bar display being indicative of a power range selected by the user for operating the audio power amplifier.

4. A method of measuring the average power of an amplified audio signal as defined by claim 2, wherein the step of processing the digital voltage data signal and the digital current data signal includes the step of:

calculating the logarithm of the average power of the amplified audio signal, the power level signal corresponding to the logarithm of the average power of the amplified audio signal, the number of illuminated segments of the plurality of segments of the first bar display being proportional to the logarithm of the average power of the amplified audio signal.

5. A method of measuring the average power of an amplified audio signal as defined by claim 4, wherein the step of calculating the logarithm of the average power of the amplified audio signal further includes the step of:

approximating the logarithm of the average power of the amplified audio signal in accordance with the following equation:

$$\log(P) \approx \log\left(\sum_{1}^{n} (vi)\right)$$

where P=the average power of the amplified audio signal, log (P)=the logarithm of P, ≈means approximately equal to, $\sum_{1}^{n}(vi)$=the summed power of the amplified audio signal, Σ=summation, n=the number of equally spaced samples taken in a predetermined period of time of the analog amplified voltage sense signal and the analog amplified current sense signal, v=the sampled voltage of the amplified audio signal, and i=the sampled current of the amplified audio signal.

6. A method of measuring the average power of an amplified audio signal as defined by claim 5, which further comprises the steps of:

storing in a look up table memory a plurality of exponentially increasing bit mask values, at least one bit mask value corresponding to at least one respective segment of the plurality of segments of the first bar display;

comparing the summed power of the amplified audio signal with the plurality of exponentially increasing bit mask values in the look up table memory; and illuminating at least one segment of the plurality of segments of the first bar display in response to the comparison of the summed power of the amplified audio signal and the plurality of exponentially increasing bit mask values.

* * * * *